US011501961B2

(12) United States Patent
Brown et al.

(10) Patent No.: US 11,501,961 B2
(45) Date of Patent: Nov. 15, 2022

(54) MASS SPECTROMETRY BY DETECTING POSITIVELY AND NEGATIVELY CHARGED PARTICLES

(71) Applicant: 908 Devices Inc., Boston, MA (US)

(72) Inventors: Christopher D. Brown, Los Gatos, CA (US); Evgeny Krylov, Franklin, MA (US); Michael Goodwin, Brookline, MA (US); Kerin Gregory, Bolton, MA (US); Andrew J. Bartfay-Szabo, North Andover, MA (US)

(73) Assignee: 908 Devices Inc., Boston, MA (US)

( * ) Notice: Subject to any disclaimer, the term of this patent is extended or adjusted under 35 U.S.C. 154(b) by 0 days.

(21) Appl. No.: 15/903,728

(22) Filed: Feb. 23, 2018

(65) Prior Publication Data

US 2018/0247803 A1 Aug. 30, 2018

Related U.S. Application Data

(62) Division of application No. 14/872,402, filed on Oct. 1, 2015, now Pat. No. 9,905,407.

(Continued)

(51) Int. Cl.

| | |
|---|---|
| ***H01J 49/00*** | (2006.01) |
| ***H01J 49/02*** | (2006.01) |
| ***H01J 49/42*** | (2006.01) |

(52) U.S. Cl.

CPC ..... *H01J 49/0095* (2013.01); *H01J 49/0036* (2013.01); *H01J 49/022* (2013.01); *H01J 49/025* (2013.01); *H01J 49/427* (2013.01)

(58) Field of Classification Search

None

See application file for complete search history.

(56) References Cited

U.S. PATENT DOCUMENTS

| | | |
|---|---|---|
| 4,066,894 A | 1/1978 | Hunt et al. |
| 4,988,867 A | 1/1991 | Laprade |

(Continued)

FOREIGN PATENT DOCUMENTS

| | | |
|---|---|---|
| EP | 0 559 202 | 9/1993 |
| WO | WO 2014/042037 | 3/2014 |

(Continued)

OTHER PUBLICATIONS

Invitation to Pay Additional Fees for International Application No. PCT/US2015/053536 dated Nov. 25, 2015 (8 pages).

(Continued)

*Primary Examiner* — Michael J Logie

(74) *Attorney, Agent, or Firm* — Fish & Richardson P.C.

(57) ABSTRACT

The disclosure features mass spectrometry systems and methods that include an ion source, an ion trap, a detector subsystem featuring first and second detector elements, and a controller electrically connected to the ion source, the ion trap, and the detector subsystem and configured so that during operation of the system, the controller: applies an electrical signal to the ion source to generate positively and negatively charged particles from sample particles in the system; applies an electrical signal to the ion trap to eject a plurality of particles from the ion trap through a common aperture of the ion trap, and determines information about the sample particles based on first and second electrical signals generated by the ejected particles.

12 Claims, 21 Drawing Sheets

Related U.S. Application Data

(60) Provisional application No. 62/059,126, filed on Oct. 2, 2014.

(56) References Cited

U.S. PATENT DOCUMENTS

| | | | | |
|---|---|---|---|---|
| 8,525,111 | B1 | 9/2013 | Brown et al. | |
| 8,816,272 | B1 * | 8/2014 | Brown | H01J 49/0031 250/282 |
| 2005/0230616 | A1 * | 10/2005 | Cameron | G01N 27/624 250/287 |
| 2008/0142727 | A1 * | 6/2008 | Ryding | H01J 37/244 250/400 |
| 2009/0294654 | A1 * | 12/2009 | Steiner | H01J 49/0095 250/283 |
| 2011/0057097 | A1 * | 3/2011 | Bateman | H01J 49/423 250/283 |
| 2011/0095177 | A1 | 4/2011 | Giannakopulos et al. | |
| 2014/0183350 | A1 | 7/2014 | Brown et al. | |
| 2014/0183355 | A1 | 7/2014 | Bartfay-Szabo et al. | |
| 2015/0255265 | A1 * | 9/2015 | Xu | H01J 49/0095 250/282 |
| 2016/0099137 | A1 | 4/2016 | Brown et al. | |
| 2016/0172172 | A1 | 6/2016 | Mizutani | |
| 2016/0299102 | A1 | 10/2016 | Harden et al. | |
| 2016/0314932 | A1 * | 10/2016 | Renner | H01J 49/0095 |
| 2017/0098534 | A1 * | 4/2017 | Brown | H01J 49/0095 |
| 2018/0197725 | A1 * | 7/2018 | Murthy | H01J 49/26 |

FOREIGN PATENT DOCUMENTS

| | | | | |
|---|---|---|---|---|
| WO | WO-2014042037 | A1 * | 3/2014 | H01J 49/10 |
| WO | WO 2014/117293 | | 8/2014 | |

OTHER PUBLICATIONS

International Search Report and the Written Opinion of the International Searching Authority for International Application No. PCT/US2015/053536 dated Mar. 30, 2016 (21 pages).

First Office Action from the Chinese Patent Office for Chinese Application No. 201580064340.3, dated Jun. 26, 2018, with its English translation.

First Office Action from the Chinese Patent Office for Chinese Application No. 201580064340.3, dated Apr. 17, 2019, with its English translation.

* cited by examiner 306
322

306
322

306
444
442
446
322
322
322

306
322

306
322
322
322

306
322
322
322
492
C
B
A

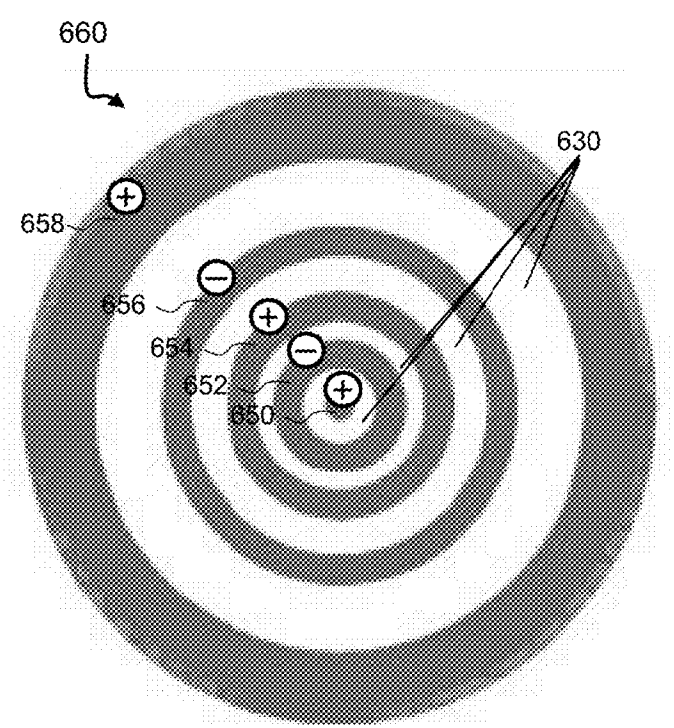
FIG. 6C
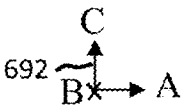
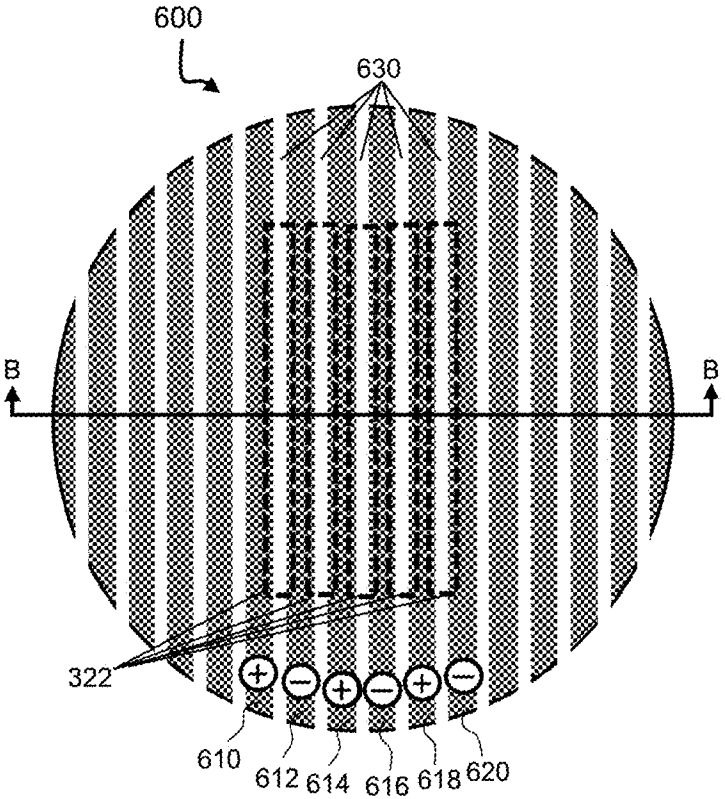
FIG. 6B
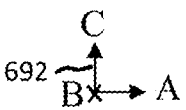

1600

| Detector Subsystem | Ion Collection Efficiency |
| --- | --- |
| Single Faraday Cup | 0.6–0.65 |
| FIG. 5B | 0.58–0.59 |
| FIG. 6B | 0.72–0.85 |
| FIG. 6C | 0.96–0.99 |

FIG. 15

MASS SPECTROMETRY BY DETECTING POSITIVELY AND NEGATIVELY CHARGED PARTICLES

CROSS-REFERENCE TO RELATED APPLICATIONS

This application is a divisional application of, and claims priority to, U.S. patent application Ser. No. 14/872,402, filed on Oct. 1, 2015, which claims priority to U.S. Provisional Patent Application No. 62/059,126, filed on Oct. 2, 2014. The entire contents of the prior applications are incorporated herein by reference in their entirety.

STATEMENT AS TO FEDERALLY SPONSORED RESEARCH

This invention was made with Government support under contract 13-C-3039 awarded by the Combating Terrorism Technical Support Office. The Government has certain rights in the invention.

TECHNICAL FIELD

This disclosure relates to mass spectrometry systems.

BACKGROUND

Mass spectrometers are widely used for the detection of chemical substances. In a typical mass spectrometer, molecules or particles are excited or ionized, and these excited species often break down to form ions of smaller mass or react with other species to form other characteristic ions. The ion formation pattern can be interpreted by a system operator to infer the identity of the compound.

SUMMARY

This disclosure describes techniques and systems for detecting positively and negatively charged particles (e.g., ions) for mass spectrometry. In particular, the disclosed mass spectrometry systems can be in compact form and operate at high pressure during the mass spectrometry measurements. The systems can include a detector subsystem which has a plurality of detector elements that receive positively and negatively charged particles. The detector elements (e.g., detector electrodes) can receive the positively and negatively charged particles at the same time. This can be achieved by ejecting positively and negatively charged particles from one or more apertures of an ion trap, and collecting the charged particles in respective detector elements according to the sign of their charges.

Additional information relating to mass spectrometry systems is disclosed, for example, in U.S. patent application Ser. No. 13/732,066, filed on Dec. 31, 2012, now published as U.S. Patent Application Publication No. US 2014/0183350, the entire contents of which are incorporated by reference.

In general, in a first aspect, the disclosure features mass spectrometry systems that include an ion source, an ion trap, a detector subsystem featuring first and second detector elements, and a controller electrically connected to the ion source, the ion trap, and the detector subsystem and configured so that during operation of the system, the controller: applies an electrical signal to the ion source to generate positively and negatively charged particles from sample particles in the system; applies an electrical signal to the ion trap to eject a plurality of particles from the ion trap through a common aperture of the ion trap, where the ejected plurality of particles includes at least some of the positively charged particles and at least some of the negatively charged particles; applies a first electrical voltage to the first detector element so that the first detector element receives the at least some of the ejected positively charged particles and generates a first electrical signal; applies a second electrical voltage to the second detector element so that the second detector element receives the at least some of the ejected negatively charged particles and generates a second electrical signal; and determines information about the sample particles based on the first and second electrical signals.

Embodiments of the systems can include any one or more of the following features.

The first and second detector elements can be separated by a distance measured in a direction orthogonal to an axis of the ion trap of 1 mm or less. A width of each of the first and second detector elements measured in a direction orthogonal to an axis of the ion trap can be 1 mm or less. The first and second detector elements can be positioned symmetrically with respect to an axis of the ion trap that passes through a center of the common aperture.

The ion trap can include an array of apertures, the detector subsystem can include an array of detector elements, and for each aperture in the array of apertures, at least two detector elements can be positioned symmetrically with respect to an axis that extends through the center of the aperture in a direction parallel to an axis of the ion trap. The detector subsystem can include electrically insulating material positioned between adjacent detector elements in the array of detector elements. The first and second detector elements can be formed from at least one material selected from the group consisting of copper, aluminum, silver, and gold. The electrically insulating material can include at least one material selected from the group consisting of ceramic materials, polyfluorinated materials, and rubber.

The controller can be configured so that during operation of the system, the controller applies an electrical signal to the ion trap to confine the positively and negatively charged particles in three dimensions within the ion trap for a minimum average trapping time of 0.1 millisecond.

Embodiments of the systems can also include any of the other aspects or features disclosed herein, including aspects and features disclosed in connection with different embodiments, in any combination as appropriate.

In another aspect, the disclosure features mass spectrometry systems that include an ion source, an ion trap, a detector subsystem featuring a plurality of detector elements, and a controller electrically connected to the ion source, the ion trap, and the detector subsystem and configured so that during operation of the system, the controller: applies an electrical signal to the ion source to generate positively and negatively charged particles from sample particles in the system; applies an electrical signal to the ion trap to eject a plurality of particles from the ion trap through a common aperture of the ion trap, where the ejected plurality of particles includes at least some of the positively charged particles and at least some of the negatively charged particles; applies a first electrical voltage to a first subset of the plurality of detector elements so that the first subset of the plurality of detector elements receives the at least some of the ejected positively charged particles and generates a first electrical signal; applies a second electrical voltage to a second subset of the plurality of detector elements so that the second subset of the plurality of detector elements receives the at least some of the ejected negatively charged particles and generates a second electrical signal; and determines information about the sample particles based on the first and second electrical signals.

Embodiments of the systems can include any one or more of the following features.

The controller can be configured so that during operation of the system, the controller adjusts electrical voltages applied to different members of the plurality of detector elements to change the members included in the first subset, the second subset, or both. The controller can be configured so that during operation of the system, the controller determines whether a peak in at least one of the first electrical signal and the second electrical signal corresponds to detected charged particles by comparing amplitudes of the first and second electrical signals at a common detection time corresponding to the peak. The controller can be configured so that during operation of the system, the controller determines that the peak corresponds to detected charged particles if the second electrical signal does not comprise a corresponding peak at the common detection time. The controller can be configured so that during operation of the system, the controller determines, for each peak in the first electrical signal and the second electrical signal, whether the peak corresponds to detected charged particles by comparing amplitudes of the first and second electrical signals at a common detection time corresponding to the peak. The controller can be configured so that during operation of the system, for each peak that is determined to correspond to detected charged particles: if the peak corresponds to positively charged particles, the controller applies the first electrical voltage to at least one member of the second subset of the plurality of detector elements to increase a number of elements in the first subset of the plurality of detector elements; and if the peak corresponds to negatively charged particles, the controller applies the second electrical voltage to at least one member of the first subset of the plurality of detector elements to increase a number of elements in the second subset of the plurality of detector elements.

The controller can be configured so that during operation of the system, when a peak is detected in the first electrical signal and a corresponding peak is not detected in the second electrical signal, the controller applies the first electrical voltage to at least one member of the second subset of the plurality of detector elements to increase a number of elements in the first subset of the plurality of detector elements. The controller can be configured so that during operation of the system, when a peak is detected in the second electrical signal and a corresponding peak is not detected in the first electrical signal, the controller applies the second electrical voltage to at least one member of the first subset of the plurality of detector elements to increase a number of elements in the second subset of the plurality of detector elements. The controller can be configured so that during operation of the system, the controller compares amplitudes of each of the first and second electrical signals to threshold values to detect peaks in the first and second electrical signals.

The controller can be configured so that during operation of the system, the controller: compares amplitudes of each of the first and second electrical signals to threshold values to detect peaks in the first and second electrical signals; determines a number of peaks in each of the first and second electrical signals; if the number of peaks in the first electrical signal is greater than the number of peaks in the second electrical signal, applies the first electrical voltage to at least one member of the second subset of the plurality of detector elements to increase a number of elements in the first subset of the plurality of detector elements; and if the number of peaks in the second electrical signal is greater than the number of peaks in the first electrical signal, applies the second electrical voltage to at least one member of the first subset of the plurality of detector elements to increase a number of elements in the second subset of the plurality of detector elements.

The controller can be configured so that during operation of the system, the controller adjusts the electrical voltages applied to different members of the plurality of detector elements based on an ionization mode of the ion source. The plurality of detector elements can include an array of electrode strips, a plurality of concentric ring electrodes, a rectangular array of detector elements, and/or a hexagonal array of detector elements. The controller can be configured so that during operation of the system, the controller applies the first and second electrical voltages at the same time to the detector elements.

The controller can be configured so that during operation of the system, the controller applies an electrical signal to the ion trap to confine the positively and negatively charged particles in three dimensions within the ion trap for a minimum average trapping time of 0.1 millisecond.

Embodiments of the systems can also include any of the other aspects or features disclosed herein, including aspects and features disclosed in connection with different embodiments, in any combination as appropriate.

In a further aspect, the disclosure features mass spectrometry systems that include an ion trap featuring first and second electrodes positioned on opposite sides of the ion trap along an axis of the ion trap, an ion source configured to introduce charged particles into the ion trap, a detector subsystem featuring at least one first detector element positioned to receive charged particles emerging from the ion trap through a first aperture in the first electrode, and at least one second detector element positioned to receive charged particles emerging from the ion trap through a second aperture in the second electrode, and a controller electrically connected to the ion source, the ion trap, and the detector subsystem and configured so that during operation of the system, the controller: applies an electrical signal to the ion source to generate positively and negatively charged particles from sample particles in the system; applies an electrical signal to the ion trap to eject a plurality of particles from the ion trap through the first and second apertures, where the plurality of particles includes at least some of the positively charged particles and at least some of the negatively charged particles; applies a first electrical voltage to the at least one first detector element so that the at least one first detector element receives positively charged particles ejected through the first aperture and generates a first electrical signal; applies a second electrical voltage to the at least one second detector element so that the at least one second detector element receives negatively charged particles ejected through the second aperture and generates a second electrical signal; and determines information about the sample particles based on the first and second electrical signals.

Embodiments of the systems can include one or more of the following features.

The first and second detector elements can be separated by a distance measured along the axis of the ion trap of 8 mm or less. The at least one first detector element can include an array of first detector elements and the at least one second detector element can include an array of second detector elements. The at least one first detector element can include a first plurality of concentric ring-shaped electrodes, and the at least one second detector element can include a second plurality of concentric ring-shaped electrodes. The detector subsystem can include at least one third detector element positioned to receive charged particles emerging from the ion trap through the first aperture in the first electrode, and at least one fourth detector element positioned to receive charged particles emerging from the ion trap through the second aperture in the second electrode.

The controller can be configured so that during operation of the system, the controller applies the second electrical voltage to the at least one third detector element so that the at least one third detector element receives negatively charged particles ejected through the first aperture and generates a third electrical signal, and applies the first electrical voltage to the at least one fourth detector element so that the at least one fourth detector element receives positively charged particles ejected through the second aperture and generates a fourth electrical signal.

The at least one third detector element can include an array of third detector elements and the at least one fourth detector element can include an array of fourth detector elements. The at least one third detector element can include a third plurality of concentric ring-shaped electrodes, and the at least one fourth detector element can include a fourth plurality of concentric ring-shaped electrodes.

The controller can be configured so that during operation of the system, the controller adjusts electrical voltages applied to the detector elements to change at least one of the first, second, third, and fourth arrays. The controller can be configured so that during operation of the system, the controller determines whether a peak in at least one of the first electrical signal and the third electrical signal corresponds to detected charged particles by comparing amplitudes of the first and third electrical signals at a common detection time corresponding to the peak. The controller can be configured so that during operation of the system, the controller determines whether a peak in at least one of the second electrical signal and the fourth electrical signal corresponds to detected charged particles by comparing amplitudes of the second and fourth electrical signals at a common detection time corresponding to the peak. The controller can be configured so that during operation of the system, the controller determines that the peak corresponds to detected charged particles if the third electrical signal does not comprise a corresponding peak at the common detection time. The controller can be configured so that during operation of the system, the controller determines that the peak corresponds to detected charged particles if the fourth electrical signal does not comprise a corresponding peak at the common detection time. The controller can be configured so that during operation of the system, the controller determines, for each peak in the first electrical signal and the third electrical signal, whether the peak corresponds to detected charged particles by comparing amplitudes of the first and third electrical signals at a common detection time corresponding to the peak. The controller can be configured so that during operation of the system, the controller determines, for each peak in the second electrical signal and the fourth electrical signal, whether the peak corresponds to detected charged particles by comparing amplitudes of the second and fourth electrical signals at a common detection time corresponding to the peak.

The controller can be configured so that during operation of the system, for each peak that is determined to correspond to detected charged particles: if the peak corresponds to positively charged particles, the controller applies the first electrical voltage to at least one member of the array of third detector elements to increase a number of elements in the array of first detector elements; and if the peak corresponds to negatively charged particles, the controller applies the third electrical voltage to at least one member of the array of first detector elements to increase a number of elements in the array of third detector elements. The controller can be configured so that during operation of the system, for each peak that is determined to correspond to detected charged particles: if the peak corresponds to positively charged particles, the controller applies the fourth electrical voltage to at least one member of the array of second detector elements to increase a number of elements in the array of fourth detector elements; and if the peak corresponds to negatively charged particles, the controller applies the second electrical voltage to at least one member of the array of fourth detector elements to increase a number of elements in the array of second detector elements.

The controller can be configured so that during operation of the system, when a peak is detected in the first electrical signal and a corresponding peak is not detected in the third electrical signal, the controller applies the first electrical voltage to at least one member of the array of third detector elements to increase a number of elements in the array of first detector elements. The controller can be configured so that during operation of the system, when a peak is detected in the third electrical signal and a corresponding peak is not detected in the first electrical signal, the controller applies the third electrical voltage to at least one member of the array of first detector elements to increase a number of elements in the array of third detector elements.

The controller can be configured so that during operation of the system, when a peak is detected in the second electrical signal and a corresponding peak is not detected in the fourth electrical signal, the controller applies the second electrical voltage to at least one member of the array of fourth detector elements to increase a number of elements in the array of second detector elements. The controller can be configured so that during operation of the system, when a peak is detected in the fourth electrical signal and a corresponding peak is not detected in the second electrical signal, the controller applies the fourth electrical voltage to at least one member of the array of second detector elements to increase a number of elements in the array of fourth detector elements.

The controller can be configured so that during operation of the system, the controller compares amplitudes of each of the first and third electrical signals to threshold values to detect peaks in the first and third electrical signals. The controller can be configured so that during operation of the system, the controller compares amplitudes of each of the second and fourth electrical signals to threshold values to detect peaks in the second and fourth electrical signals.

The controller can be configured so that during operation of the system, the controller: compares amplitudes of each of the first and third electrical signals to threshold values to detect peaks in the first and third electrical signals; determines a number of peaks in each of the first and third electrical signals; if the number of peaks in the first electrical signal is greater than the number of peaks in the third electrical signal, applies the first electrical voltage to at least one member of the array of third detector elements to increase a number of elements in the array of first detector elements; and if the number of peaks in the third electrical signal is greater than the number of peaks in the first electrical signal, applies the third electrical voltage to at least one member of the array of first detector elements to increase a number of elements in the array of third detector elements. The controller can be configured so that during operation of the system, the controller: compares amplitudes of each of the second and fourth electrical signals to threshold values to detect peaks in the second and fourth electrical signals; determines a number of peaks in each of the second and fourth electrical signals; if the number of peaks in the second electrical signal is greater than the number of peaks in the fourth electrical signal, applies the second electrical voltage to at least one member of the array of fourth detector elements to increase a number of elements in the array of second detector elements; and if the number of peaks in the fourth electrical signal is greater than the number of peaks in the second electrical signal, applies the fourth electrical voltage to at least one member of the array of second detector elements to increase a number of elements in the array of fourth detector elements.

The controller can be configured so that during operation of the system, the controller adjusts the electrical voltages applied to the detector elements to change at least one of the first, second, third, and fourth arrays based on an ionization mode of the ion source. Each of the first, second, third, and fourth arrays of detector elements can include an array of electrode strips, a rectangular array of detector elements, and/or a hexagonal array of detector elements.

The controller can be configured so that during operation of the system, the controller applies the first and third electrical voltages at the same time to the detector elements. The controller can be configured so that during operation of the system, the controller applies the second and fourth electrical voltages at the same time to the detector elements. The controller can be configured so that during operation of the system, the controller applies the first, second, third, and fourth electrical voltages at the same time to the detector elements.

The controller can be configured so that during operation of the system, the controller applies an electrical signal to the ion trap to confine the positively and negatively charged particles in three dimensions within the ion trap for a minimum average trapping time of 0.1 millisecond.

Embodiments of the systems can also include any of the other aspects and features disclosed herein, including aspects and features disclosed in combination with different embodiments, in any combination as appropriate.

In another aspect, the disclosure features methods that include applying an electrical signal to an ion source to generate positively and negatively charged particles from sample particles, applying an electrical signal to an ion trap to eject a plurality of particles through a common aperture of the ion trap, where the ejected particles include at least some of the positively and negatively charged particles, applying a first electrical voltage to a first detector element so that the first detector element receives the at least some of the ejected positively charged particles and generates a first electrical signal, applying a second electrical voltage to the second detector element so that the second detector element receives the at least some of the ejected negatively charged particles and generates a second electrical signal, and determining information about the sample particles based on the first and second electrical signals.

Embodiments of the methods can include any of the steps and features disclosed herein, including steps and features disclosed in connection with different embodiments, in any combination as appropriate.

In a further aspect, the disclosure features methods that include applying an electrical signal to an ion source to generate positively and negatively charged particles from sample particles, applying an electrical signal to an ion trap to eject a plurality of particles from the ion trap, where the ejected particles include at least some of the positively and negatively charged particles, and applying electrical voltages to a detector subsystem that includes a plurality of detector elements, where applying the electrical voltages includes: applying a first electrical voltage to a first subset of the plurality of detector elements so that the first subset of the plurality of detector elements receives the at least some of the ejected positively charged particles and generates a first electrical signal; applying a second electrical voltage to a second subset of the plurality of detector elements so that the second subset of the plurality of detector elements receives the at least some of the ejected negatively charged particles and generates a second electrical signal; determining information about the sample particles based on the first and second electrical signals; and adjusting electrical voltages applied to the plurality of detector elements based on the determined information.

Embodiments of the methods can include any one or more of the following features.

The methods can include adjusting electrical voltages applied to different members of the plurality of detector elements to change the members included in the first subset, the second subset, or both.

The methods can include determining whether a peak in at least one of the first electrical signal and the second electrical signal corresponds to detected charged particles by comparing amplitudes of the first and second electrical signals at a common detection time corresponding to the peak. The methods can include determining that the peak corresponds to detected charged particles if the second electrical signal does not include a corresponding peak at the common detection time.

The methods can include determining, for each peak in the first electrical signal and the second electrical signal, whether the peak corresponds to detected charged particles by comparing amplitudes of the first and second electrical signals at a common detection time corresponding to the peak. The methods can include, for each peak that is determined to correspond to detected charged particles: if the peak corresponds to positively charged particles, applying the first electrical voltage to at least one member of the second subset of the plurality of detector elements to increase a number of elements in the first subset of the plurality of detector elements; and if the peak corresponds to negatively charged particles, applying the second electrical voltage to at least one member of the first subset of the plurality of detector elements to increase a number of elements in the second subset of the plurality of detector elements.

The methods can include, when a peak is detected in the first electrical signal and a corresponding peak is not detected in the second electrical signal, applying the first electrical voltage to at least one member of the second subset of the plurality of detector elements to increase a number of elements in the first subset of the plurality of detector elements. The methods can include, when a peak is detected in the second electrical signal and a corresponding peak is not detected in the first electrical signal, applying the second electrical voltage to at least one member of the first subset of the plurality of detector elements to increase a number of elements in the second subset of the plurality of detector elements. The methods can include comparing amplitudes of each of the first and second electrical signals to threshold values to detect peaks in the first and second electrical signals.

The methods can include comparing amplitudes of each of the first and second electrical signals to threshold values to detect peaks in the first and second electrical signals, determining a number of peaks in each of the first and second electrical signals, and: if the number of peaks in the first electrical signal is greater than the number of peaks in the second electrical signal, applying the first electrical voltage to at least one member of the second subset of the plurality of detector elements to increase a number of elements in the first subset of the plurality of detector elements; if the number of peaks in the second electrical signal is greater than the number of peaks in the first electrical signal, applying the second electrical voltage to at least one member of the first subset of the plurality of detector elements to increase a number of elements in the second subset of the plurality of detector elements.

The methods can include adjusting the electrical voltages applied to different members of the plurality of detector elements based on an ionization mode of the ion source. The plurality of detector elements can include an array of electrode strips, a plurality of concentric ring electrodes, a rectangular array of detector elements, and/or a hexagonal array of detector elements. The methods can include applying the first and second electrical voltages at the same time to the detector elements.

The methods can include applying an electrical signal to the ion trap to confine the positively and negatively charged particles in three dimensions within the ion trap for a minimum average trapping time of 0.1 millisecond.

Embodiments of the methods can also include any of the other steps or features disclosed herein, including steps and features disclosed in connection with different embodiments, in any combination as appropriate.

The disclosed techniques and systems can provide numerous benefits and advantages (some of which can be achieved only in some of the various aspects and embodiments) including the following. Both positively and negatively charged particles can be detected at the same time. Such detection can be achieved in mass spectrometry systems that have compact sizes and are capable of operating at relatively high pressures. Due to the components and arrangement of the systems, recombination between oppositely charged particles can be reduced, and thereby increase the efficiency of particle collection. The systems can be used to detect charged particles with opposite signs at the same time and reduce the data acquisition time. In some embodiments, electrical signals generated by detector elements receiving oppositely charged particles can be used in coherent detection schemes to reduce noises in data acquisition. Such an approach can increase the sensitivity of the mass spectrometry measurements. Further, some sample particles generate positively and negatively charged particles with distinct mass-to-charge ratio spectra. Measuring such distinct mass-to-charge spectra can provide complementary information and increase the selectivity of the measurements. Further, detecting both positively and negatively charged particles can provide information about which ionization mode of the ion source is suitable for a particular sample.

In some embodiments, the mass spectrometry systems can include a detector subsystem having a plurality of detector elements. A controller can adjust the electrical voltages applied to individual detector elements so as to control the sign of charged particles collected by respective detector elements. For example, by adjusting the electrical voltage so the detector elements collect the sign of charged particles that are dominant in the ion trap of the systems, the detector subsystems can effectively collect charged particles originating from sample particles and the sensitivity of the measurements can be increased. The disclosed techniques can provide flexibility of controlling sensitivity and selectivity depending on the sample particles being analyzed.

Unless otherwise defined, all technical and scientific terms used herein have the same meaning as commonly understood by one of ordinary skill in the art to which this disclosure belongs. Although methods and materials similar or equivalent to those described herein can be used in the practice or testing of the subject matter herein, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments are set forth in the accompanying drawings and the description below. Other features and advantages will be apparent from the description, drawings, and claims.

DESCRIPTION OF DRAWINGS

FIG. 6B is a schematic diagram of the detector subsystem shown in FIG. 6A at another perspective.

FIG. 6C is a schematic diagram of another example of a detector subsystem.

FIG. 15 is a table showing simulation results of ion collection efficiencies for various examples of detector subsystems.

Like reference symbols in the various drawings indicate like elements.

DETAILED DESCRIPTION

Introduction

Figure 1A:
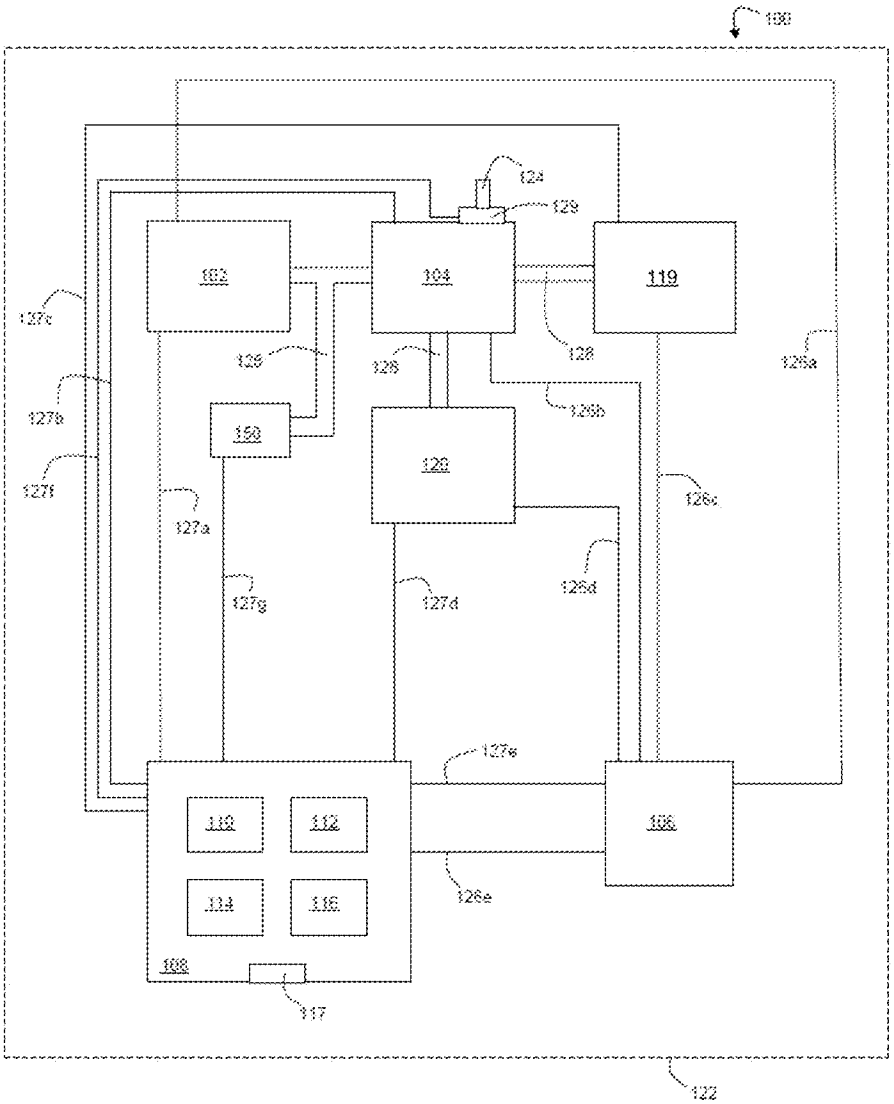
FIG. 1A is a schematic diagram of a mass spectrometer.

Mass spectrometers that are used for identification of chemical substances are typically large, complex instruments that consume considerable power. Such instruments are frequently too heavy and bulky to be portable, and thus are limited to applications in environments where they can remain essentially stationary. For example, conventional mass spectrometers are typically used in laboratory settings that allow ample space, power of operation and the use of a series of pumps for evacuating the interior volume of the spectrometers to low pressures.

To achieve high sensitivity and resolution, conventional mass spectrometers typically use several components and arrangements that lead to their bulky volume and lack of compactness. For example, conventional mass spectrometers typically have a low pressure vacuum chamber with a large volume and their ion sources and ion detectors are separated by a large distance. Ionized particles travel long distances in low-pressure before being collected by the ion detectors to achieve high sensitivity and resolution, such as in time of flight measurements. When charged particles travel longer distances, recombination between oppositely charged particles can become more likely. Thus, in this case, conventional mass spectrometers may operate to selectively direct either one of positively or negatively charged particles towards their detectors. As a result, such spectrometers measure oppositely charged particles sequentially, rather than detecting both positively and negatively charged particles at the same time.

Other factors can lead to large volumes and traveling distances of charged particles in conventional mass spectrometers. Conventional ion detectors such as electron multipliers are bulky such that if two electron multipliers are placed next to each other, and one electron multiplier is selected to detect positively charged particles and the other electron multiplier is selected to detect negatively charged particles, the charged particles travel a relatively long distance in order to be separated before being collected by their respective electron multipliers. Such an arrangement is typically avoided due to concerns relating to recombination of the charged particles and sensitivity of detection. Some conventional mass spectrometers use quadrupole deflectors to separate oppositely charged particles. However, such deflectors typically require a large volume to separate the charged particles by bending their trajectories in opposite directions.

As another example, conventional ion sources can include thermionic emitters that can generate ions with high kinetic energy, which can further ionize sample particles to also have high kinetic energy. The high kinetic energy can increase the probability of recombination between oppositely charged particles, and thus the conventional mass spectrometers may operate to selectively direct either only positively or negatively charged particles towards the detectors to avoid recombination, rather than detecting both signs of charged particles at the same time.

As a result, mass spectrometers with significantly different configurations and components are needed to effectively measure both positively and negatively charged particles at the same time. The mass spectrometers disclosed herein are capable of such measurements while also being compact and operating at high pressures (e.g., pressures larger than 100 mTorr).

The mass spectrometers disclosed herein provide a compact arrangement so that traveling distances of charged particles can be significantly reduced compared to conventional mass spectrometers. The probability of recombination between opposite charged particles becomes less as the traveling distances are reduced. Hence, the disclosed spectrometers can efficiently detect both positively and negatively charged particles due to reduced recombination effects.

Moreover, because the charged particles need not travel relatively large distances, the spectrometers can typically operate within a pressure range of 100 mTorr to 100 Torr, which is significantly higher than the operating pressure range of conventional mass spectrometers. As a result, the mass spectrometers disclosed herein can feature efficient ion sources such as glow discharge ionization sources and/or capacitive discharge ionization sources. In particular, glow discharge ionization sources can produce relatively low kinetic energy ions compared to ions produced by thermionic emitters, and thus recombination effects can be reduced. Moreover, the low-current pulsed ion sources further reduce power consumption relative to continuous thermal ion sources such as thermionic emitters that are commonly found in conventional mass spectrometers. Reduced power consumption is an important consideration in compact mass spectrometry systems.

The mass spectrometry systems disclosed herein can include a detector subsystem having a plurality of detector elements that are selectively biased to detect charged particles of a particular sign. For example, the detector elements can each include an electrode. Individual electrodes can be fabricated to have a small areas, unlike bulky electron multipliers that are present in conventional mass spectrometers. Furthermore, the detector subsystem can include efficient, low power detectors such as Faraday detectors, rather than the more power hungry electron multipliers. As a result of the compact and low power components, the mass spectrometers disclosed herein can be compact, reduce recombination effects, operate efficiently and consume relatively small amounts of electrical power while being able to detect both positively and negatively charged particles at the same time. Such detection can reduce data acquisition time and provide richer information about samples of interest. Further, the mass spectrometers can be powered by standard battery-based power sources (e.g., Li ion batteries), and are portable with a handheld form factor.

FIG. 1A is a schematic diagram of an embodiment of a compact mass spectrometer 100. Spectrometer 100 includes an ion source 102, an ion trap 104, a voltage source 106, a controller 108, a pressure regulation subsystem 120, and a sample inlet 124. The mass spectrometer 100 also includes a detector subsystem 119 which includes a plurality of detector elements. The detector subsystem 119 can include one or more detectors that each include detector elements. For example, the detector subsystem 119 can include only one detector that has multiple detector elements. In some embodiments, the detector subsystem 119 can include multiple detectors, where each detector has only one detector element or multiple detector elements. Individual detector elements can be electrodes.

Sample inlet 124 includes a valve 129. Some embodiments do not have the valve 129. Optionally included in spectrometer 100 is a buffer gas source 150. The components of spectrometer 100 are enclosed within a housing 122. Controller 108 includes an electronic processor 110, a user interface 112, a storage unit 114, a display 116, and a communication interface 117. Generally, various components need not be arranged specifically as shown in FIG. 1A. For example, detector subsystem 119 can have detectors positioned at two opposite sides of ion trap 104 to collect particles at the two sides.

Controller 108 is connected to ion source 102, ion trap 104, detector subsystem 119, pressure regulation subsystem 120, voltage source 106, valve 129, and optional buffer gas source 150 via control lines 127*a*-127*g*, respectively. Control lines 127*a*-127*g* permit controller 108 (e.g., electronic processor 110 in controller 108) to issue operating commands to each of the components. For example, commands can include signals that activate ion source 102, ion trap 104, detector subsystem 119, pressure regulation subsystem 120, valve 129, and buffer gas source 150. Activating signals can include instructions to voltage source 106 to apply electrical voltages to elements of the components. By applying electrical voltages, electrical potentials are applied to elements of the components. For example, such instructions can include signals to apply electrical potentials to: electrodes in ion source 102, electrodes in ion trap 104, detector elements (e.g., electrodes) of detector subsystem 119. Controller 108 can also transmit signals to activate pressure regulation subsystem 120 (e.g., through voltage source 106) to control the gas pressure, and to valve 129 to allow gas particles to enter through sample inlet 124.

Further, controller 108 can receive signals from each of the components of spectrometer 100 through control lines 127*a*-127*g*. The signals can include information about the operational characteristics of ion source 102 and/or ion trap 104 and/or detector 118 and/or pressure regulation subsystem 120. The information can include: ion currents measured by detector subsystem 119, which are related to abundances of ions with specific mass-to-charge ratios; and specific voltages applied to electrodes of ion trap 104 as particles are measured by detector subsystem 119. The specific applied voltages are related to specific values of mass-to-charge ratio for the ions. By correlating the voltage information with the measured abundance information, controller 108 can determine abundances of ions as a function of mass-to-charge ratio, and can present this information using display 116 in the form of mass spectra.

Voltage source 106 is connected to ion source 102, ion trap 104, detector subsystem 119, pressure regulation subsystem 120, and controller 108 via control lines 126*a*-*e*, respectively, and provided electrical voltages, electrical potentials and electrical power to each of these components. Voltage source 106 establishes a reference potential that corresponds to an electrical ground at a relative voltage of 0 Volts. Potentials applied by voltage source 106 to the various components of spectrometer 100 are referenced to this ground potential. In general, voltage source 106 is configured to apply potentials that are positive and potentials that are negative, relative to the reference ground potential. By applying potentials of different signs to these components (e.g., to the electrodes of the components), electric fields of different signs can be generated within the components, which cause charged particles to move in different directions.

Various components shown in FIG. 1A are connected by gas path 128. For example, ion source 102, ion trap 104, and detector subsystem 119 are connected such that an internal pathway for gas particles and ions, gas path 128, extends between these components. Generally, embodiments can have different arrangements between different components, and the gas path 128 depends on the specific arrangement. The direction of movement of gas particles and ions can move in any direction in gas path 128, which can be controlled by applying electric potentials within system 100 to guide charged particles or by generating pressure gradients through pressure regulation subsystem 120. For example, by applying suitable electrical potentials to electrodes in ion source 102 and ion trap 104, ions generated in ion source 102 can be directed to flow from ion source 102 into ion trap 104.

Figure 1B:
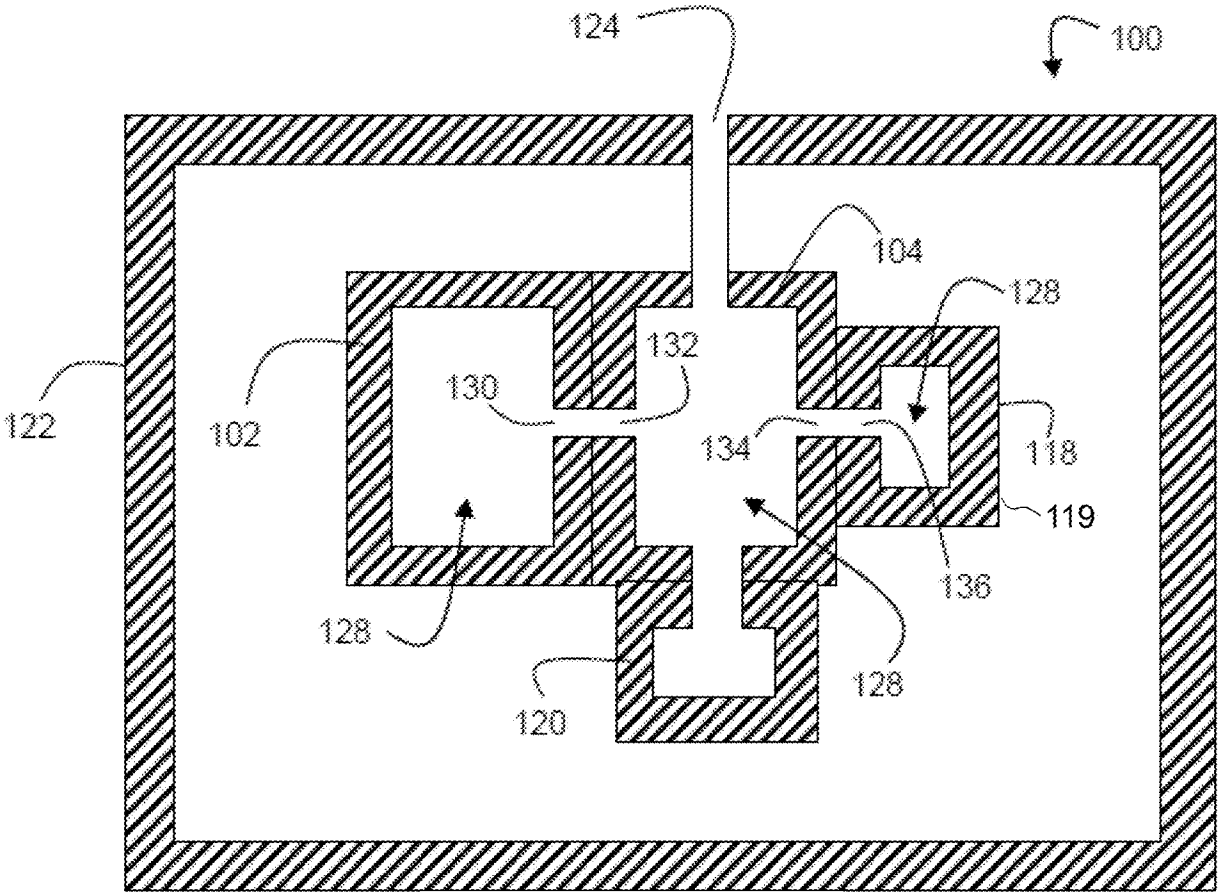
FIG. 1B is a partial cross-sectional diagram of a mass spectrometer.

FIG. 1B is a partial cross-sectional diagram of mass spectrometer 100. As shown in FIG. 1B, an output aperture 130 of ion source 102 is coupled to an input aperture 132 of ion trap 104. Further, an output aperture 134 of ion trap 104 is coupled to an input aperture 136 of detector 118 of detector subsystem 119. As a result, ions and gas particles can flow in any direction between ion source 102, ion trap 104, and detector 118. During operation of spectrometer 100, pressure regulation subsystem 120 operates to reduce the gas pressure in gas path 128 to a value that is less than atmospheric pressure. As a result, gas particles to be analyzed enter sample inlet 124 from the environment surrounding spectrometer 100 (e.g., the environment outside housing 122) and move into gas path 128. Gas particles that enter ion source 102 through gas path 128 are ionized by ion source 102. The ions propagate from ion source 102 into ion trap 104, where they are trapped by electrical fields created when voltage source 106 applies suitable electrical potentials to the electrodes of ion trap 104. In some embodiments, ions generated by ion source 102 propagate into ion trap 104 and ionize the gas particles to generate ions to be analyzed within the ion trap 104.

The trapped ions circulate within ion trap 104. To analyze the circulating ions, voltage source 106, under the control of controller 108, varies the amplitude of a radiofrequency trapping field applied to one or more electrodes of ion trap 104. The variation of the amplitude occurs repetitively, defining a sweep frequency for ion trap 104. As the amplitude of the field is varied, ions with specific mass-to-charge ratios fall out of orbit and some are ejected from ion trap 104. When the ions are ejected from the ion trap 104, they can travel towards the detector subsystem 119 as positively and negatively charged particles. The ejected ions are detected by detector subsystem 119, and information about the detected ions (e.g., measured ion currents from detector 118, and specific voltages that are applied to ion trap 104 when particular ion currents are measured) is transmitted to controller 108.

In some embodiments, sample inlet 124 can be positioned at other locations. For example, sample inlet 124 can be positioned so that gas particles directly enter ion source 102 from the environment outside housing 122. Sample inlet 124 can generally be positioned at any location along gas path 128, provided that the position of sample inlet 124 allows gas particles to enter gas path 128 from the environment outside housing 122. Also, ion source 102 need not be positioned on the opposite side of detector subsystem 119. For example, the positions of ion source 102 and pressure regulation subsystem 120 can be reversed in FIG. 1B so that the ion source 102 is located on the opposite side of sample inlet 124.

Communication interface 117 can be a wired or wireless communication interface (or both) and configured to communicate with a wide variety of devices, including remote computers, mobile phones, and monitoring and security scanners. Communication interface 117 can be configured to transmit and receive information (e.g., operating and configuration settings for spectrometer 100, and information relating to substances of interest, including records of mass spectra of known substances, hazards associated with particular substances, classes of compounds) over a variety of networks, including but not limited to Ethernet networks, wireless WiFi networks, cellular networks, and Bluetooth wireless networks.

The mass spectrometer systems and methods disclosed herein are compact, mobile, and achieve low power operation. These characteristics are realized in part by eliminating the turbomolecular, rough, and other large mechanical pumps that are common to conventional spectrometers. In place of these large pumps, small, low power single mechanical pumps are used to control gas pressure within the mass spectrometer systems. The single mechanical pumps used in the mass spectrometer systems disclosed herein cannot reach pressures as low as conventional turbomolecular pumps. As a result, the systems disclosed herein operate at higher internal gas pressures than conventional mass spectrometers are capable of operating.

By using a single, small mechanical pump, the weight, size, and power consumption of the mass spectrometers disclosed herein is substantially reduced relative to conventional mass spectrometers. Thus, the mass spectrometers disclosed herein generally include pressure regulation subsystem 120, which features a small mechanical pump, and which is configured to maintain an internal gas pressure (e.g., a gas pressure in gas path 128, and in ion source 102, ion trap 104, and detector subsystem 119, all of which are connected to gas path 128) of between 100 mTorr and 100 Torr (e.g., between 100 mTorr and 500 mTorr, between 500 mTorr and 100 Torr, between 500 mTorr and 10 Torr, between 500 mTorr and 5 Torr, between 100 mTorr and 1 Torr). In some embodiments, the pressure regulation subsystem is configured to maintain an internal gas pressure in the mass spectrometers disclosed herein of more than 100 mTorr (e.g., more than 500 mTorr, more than 1 Torr, more than 10 Torr, more than 20 Torr).

In some embodiments, pressure regulation subsystem 120 is configured to maintain the same pressure in each of ion source 102, ion trap 104, and detector subsystem 119. In certain embodiments, the pressure in one or more of these components can differ from the pressures in the other components during operation. However, pressure regulation subsystem 120 is configured so that, even if the pressures in one or more of these components differ, the pressure in each component is still between 100 mTorr and 100 Torr (e.g., between 100 mTorr and 500 mTorr, between 500 mTorr and 100 Torr, between 500 mTorr and 10 Torr, between 500 mTorr and 5 Torr, between 100 mTorr and 1 Torr).

In general, when the pressure in one of ion source 102, ion trap 104, and detector subsystem 119 differs from the pressure in at least one of the others of these components during operation, the pressure difference is relatively small. For example, the pressure difference can be 50 mTorr or less (e.g., 30 mTorr or less, 10 mTorr or less, 5 mTorr or less, 1 mTorr or less, 0.1 mTorr or less). Similar pressure differences can occur between any two of ion source 102, ion trap 104, and detector subsystem 119 when the pressure in each of these components is different during operation.

At the foregoing pressures, the mass spectrometers disclosed herein detect ions at a resolution of 10 amu or better. For example, in some embodiments, the resolution of the mass spectrometers disclosed herein, measured as described above, is 10 amu or better (e.g., 8 amu or better, 6 amu or better, 5 amu or better, 4 amu or better, 3 amu or better, 2 amu or better, 1 amu or better). In general, any of these resolutions can be achieved at any of the foregoing pressures using the mass spectrometers disclosed herein.

As used herein, "resolution" is defined as the full width at half-maximum (FWHM) of a measured mass peak. The resolution of a particular mass spectrometer is determined by measuring the FWHM for all peaks that appear within the range of mass-to-charge ratios from 100 to 125 amu, and selecting the largest FWHM that corresponds to a single peak (e.g., peak widths that correspond to closely spaced sets of two or more peaks are excluded) as the resolution. To determine the resolution, a chemical substance with a well known mass spectrum, such as toluene, can be used.

As shown in FIG. 1B, the internal volume of the mass spectrometers disclosed herein includes the internal volumes of ion source 102, ion trap 104, and detector subsystem 119, and regions between these components. More generally, the internal volume of the mass spectrometers disclosed herein corresponds to the volume of gas path 128—that is, the volumes of all of the connected spaces within mass spectrometer 100 where gas particles and ions can circulate. In some embodiments, the internal volume of mass spectrometer 100 is 10 $cm^3$ or less (e.g., 7.0 $cm^3$ or less, 5.0 $cm^3$ or less, 4.0 $cm^3$ or less, 3.0 $cm^3$ or less, 2.5 $cm^3$ or less, 2.0 $cm^3$ or less, 1.5 $cm^3$ or less, 1.0 $cm^3$ or less).

Spectrometer 100 can be compact and portable. In some embodiments, for example, the spectrometer 100 can include a module that integrates several components such as ion source 102, ion trap 104 and detector subsystem 119. In certain embodiments, a maximum dimension of the module (e.g., a maximum linear distance between any two points on the module) is 10 cm or less (e.g., 9 cm or less, 8 cm or less, 7 cm or less, 6 cm or less, 5 cm or less, 4 cm or less, 3 cm or less, 2 cm or less, 1 cm or less).

In the following sections, the various components of mass spectrometer 100 will be discussed in greater detail, and various operating modes of spectrometer 100 will also be discussed. In particular, various arrangements of ion trap 104 and detector subsystem 119 for collecting positively and negatively charged particles are described.

Ion Source

In general, ion source 102 is configured to generate electrons and/or ions. Where ion source 102 generates ions directly from gas particles that are to be analyzed, the ions are then transported from ion source 102 to ion trap 104 by suitable electrical potentials applied to the electrodes of ion source 102 and ion trap 104. Depending upon the magnitude and polarity of the potentials applied to the electrodes of ion source 102 and the chemical structure of the gas particles to be analyzed (also referred as "sample particles"), the ions generated by ion source 102 can be positive or negative ions. In some embodiments, electrons and/or ions generated by ion source 102 can collide with neutral gas particles to be analyzed to generate ions from the gas particles.

By operating at higher internal gas pressures than conventional mass spectrometers, the compact mass spectrometers disclosed herein can use a variety of ion sources. In particular, ion sources that are small and that require relatively modest amounts of electrical power to operate can be used in spectrometer 100. In some embodiments, for example, ion source 102 can be a glow discharge ionization (GDI) source. In certain embodiments, ion source 102 can be a capacitive discharge ion source.

GDI sources are particularly advantageous for use in spectrometer 100 because they are compact and well suited for low power operation. The glow discharge that occurs when these sources are active occurs only when gas pressures are sufficient, however. Typically, for example, GDI sources are practically limited in operation to gas pressures of approximately 200 mTorr and above. At pressures lower than 200 mTorr, sustaining a stable glow discharge can be difficult without very high applied voltages and large electrode gaps. As a result, GDI sources are not used in conventional mass spectrometers, which operate at pressures of 1 mTorr or less. However, because the mass spectrometers disclosed herein typically operate at gas pressures of between 100 mTorr and 100 Torr, GDI sources can be used.

Figure 2:
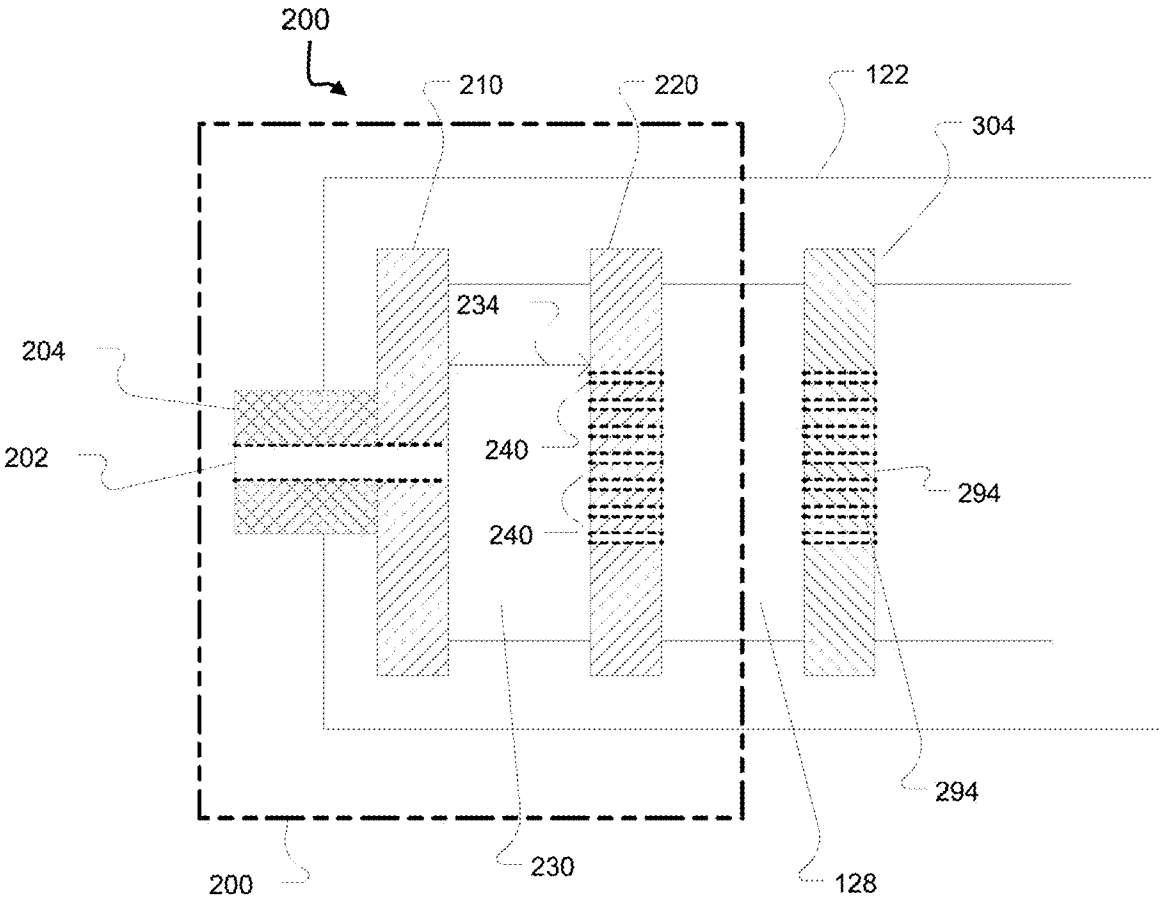
FIG. 2 is a schematic diagram of glow discharge ion source.

FIG. 2 is a schematic diagram of an example of a GDI source 200 that includes a front electrode 210 and a back electrode 220. In this example, the two electrodes 210 and 220, along with the housing 122, form the GDI chamber 230. The front electrode 210 has an aperture 202 in which gas particles to be analyzed enter GDI chamber 230. As used herein, the term "gas particles" refers to atoms, molecules, or aggregated molecules of a gas that exist as separate entities in the gaseous state. For example, if the substance to be analyzed is an organic compound, then the gas particles of the substance are individual molecules of the substance in the gas phase.

In FIG. 2, aperture 202 is surrounded by an insulating tube 204. Gas particles to be analyzed are drawn into GDI chamber 230 due to the pressure difference between the atmosphere external to spectrometer 100 and GDI chamber 230 through aperture 202. In addition to gas particles to be analyzed, atmospheric gas particles are also drawn into GDI chamber 230 due to the pressure difference. As used herein, the term "atmospheric gas particles" refers to atoms or molecules of gases in air, such as molecules of oxygen gas and nitrogen gas.

In some embodiments, additional gas particles can be introduced into GDI source 200 to assist in the generation of electrons and/or ions in the source. For example, as explained above in connection with FIG. 1A, spectrometer 100 can include a buffer gas source 150 connected to gas path 128. Buffer gas particles from buffer gas source 150 can be introduced directly into GDI source 200, or can be introduced into another portion of gas path 128 and diffuse into GDI source 200. The buffer gas particles can include nitrogen molecules, and/or noble gas atoms (e.g., He, Ne, Ar, Kr, Xe). Some of the buffer gas particles can be ionized by electrodes 210 and 220.

Generally aperture 202 can be positioned at a variety of locations in spectrometer 100. For example, aperture 202 can be positioned in a sidewall of GDI chamber 230, where it is connected to sample inlet 124. Further, as has been described previously, in some embodiments sample inlet 124 can be positioned so that gas particles to be analyzed are drawn directly into another one of the components of spectrometer 100, such as ion trap 104 or detector subsystem 119. When the gas particles are drawn into a component other than ion source 102, the gas particles diffuse through gas path 128 and into ion source 102. Alternatively, or in addition, when the gas particles to be analyzed are drawn directly into a component such as ion trap 104, ion source 102 can generate ions and/or electrons which then collide with the gas particles to be analyzed within ion trap 104, generating ions from the gas particles directly inside the ion trap.

During operation, GDI source 200 generates a self-sustaining glow discharge (or plasma) when a voltage difference is applied between front electrode 210 and back electrode 220 by voltage source 106 under the control of controller 108. In some embodiments, the voltage difference can be 200 V or higher (e.g., 300 V or higher, 400 V or higher, 500 V or higher, 600 V or higher, 700 V or higher, 800 V or higher) to sustain the glow discharge.

By applying electrical potentials of differing polarity relative to the ground potential established by voltage source 106, GDI source 200 can be configured to operate in different ionization modes. For example, during typical operation of GDI source 200, a small fraction of gas particles is initially ionized in GDI chamber 230 due to random processes (e.g., thermal collisions). In some embodiments, electrical potentials are applied to front electrode 210 and back electrode 220 such that front electrode 210 serves as the cathode and back electrode 220 serves as the anode. In this configuration, positive ions generated in GDI chamber 230 are driven towards the front electrode 210 due to the electric field within the chamber. Negative ions and electrons are driven towards the back electrode 220. The electrons and ions can collide with other gas particles, generating a larger population of ions. Negative ions and/or electrons exit GDI chamber 230 through the back electrode 220. In certain embodiments, suitable electrical potentials are applied to front electrode 210 and back electrode 220 so that front electrode 210 serves as the anode and back electrode 220 serves as the cathode. In this configuration, positively charged ions generated in GDI chamber 230 leave the chamber through back electrode 220. The positively charged ions can collide with other gas particles, generating a larger population of ions. After ions are generated and leave GDI chamber 230 through back electrode 220 in either operating mode, the ions enter ion trap 104 through end cap electrode 304.

In general, back electrode 220 can include one or more apertures 240. The number of apertures can be 2 or more (e.g., 4 or more, 8 or more, 16 or more, 24 or more, 48 or more, 64 or more, 100 or more, 200 or more, 300 or more, 500 or more). The number of apertures 240 and their cross-sectional shapes are generally chosen to create a relatively uniform spatial distribution of ions incident on end cap electrode 304. As the ions generated in GDI chamber 230 leave the chamber through the one or more apertures 240 in back electrode 220, the ions spread out spatially from one another due to collisions and space-charge interactions. As a result, the overall spatial distribution of ions leaving GDI source 200 diverges. By selecting a suitable number of apertures 240 having particular cross-sectional shapes, the spatial distribution of ions leaving GDI source 200 can be controlled so that the distribution overlaps or fills all of the apertures 292 formed in end cap electrode 304. In some embodiments, back electrode 220 includes a single aperture 240. The cross-sectional shape of aperture 240 can be circular, square, rectangular, or can correspond more generally to any regularly or irregularly shaped n-sided polygon. In certain embodiments, the cross-sectional shape of aperture 240 can be irregular.

In some embodiments, back electrode 220 and end cap electrode 304 can be formed as a single element, and ions formed in GDI chamber 230 can directly enter the ion trap 104 by passing through the element. In such embodiments, the combined back and end cap electrode can include a single aperture or multiple apertures, as described above.

Various operating modes can be used to generate charged particles in GDI source 200. For example, in some embodiments, a continuous operating mode is used. In this mode, charged particles are continuously generated within the ion source. In some embodiments, GDI source 200 is configured for pulsed operation.

A variety of materials can be used to form the electrodes in ion source 102, including electrodes 210 and 220 in GDI source 200. For example, the electrodes can be made from materials such as copper, aluminum, silver, nickel, gold, and/or stainless steel. In general, materials that are less prone to adsorption of sticky particles are advantageous, as the electrodes formed from such materials typically require less frequent cleaning or replacement.

The foregoing techniques described for GDI source 200 are equally applicable to other types of ion sources that can be used in spectrometer 100, such as capacitive discharge sources that are well suited for use at the relatively high gas pressures at which spectrometer 100 operates. Additional aspects and features of capacitive discharge sources are disclosed, for example, in U.S. Pat. No. 7,274,015, the entire contents of which are incorporated herein by reference.

Due to the use of compact, closely spaced electrodes, the overall size of ion source 102 can be small. The maximum dimension of ion source 102 refers to the maximum linear distance between any two points on the ion source. In some embodiments, the maximum dimension of ion source 102 is 8.0 cm or less (e.g., 6.0 cm or less, 5.0 cm or less, 4.0 cm or less, 3.0 cm or less, 2.0 cm or less, 1.0 cm or less).

Ion Trap

Ions generated by ion source 102 are trapped within ion trap 104, where they circulate under the influence of electrical fields created by applying electrical potentials to the electrodes of ion trap 104. The potentials are applied to the electrodes of ion trap 104 by voltage source 106, after receiving control signals from controller 108. To eject the circulating ions from ion trap 104 for detection, controller 108 transmits control signals to voltage source 106 which cause voltage source 106 to modulate the amplitude of a radiofrequency (RF) field within ion trap 104. Modulation of the amplitude of the RF field causes the circulating ions within ion trap 104 to fall out of orbit and exit ion trap 104, entering detector 118 where they are detected.

To ensure that gas particles drawn in to spectrometer 100 are quickly ionized and analyzed, the internal volume of mass spectrometer 100 is considerably smaller than the internal volume of conventional mass spectrometers. By reducing the internal volume of spectrometer 100, pressure regulation subsystem 120 is capable of drawing gas particles quickly into spectrometer 100. Further, by ensuring quick ionization and analysis, a user of spectrometer 100 can rapidly obtain information about a particular substance.

Figure 3A:
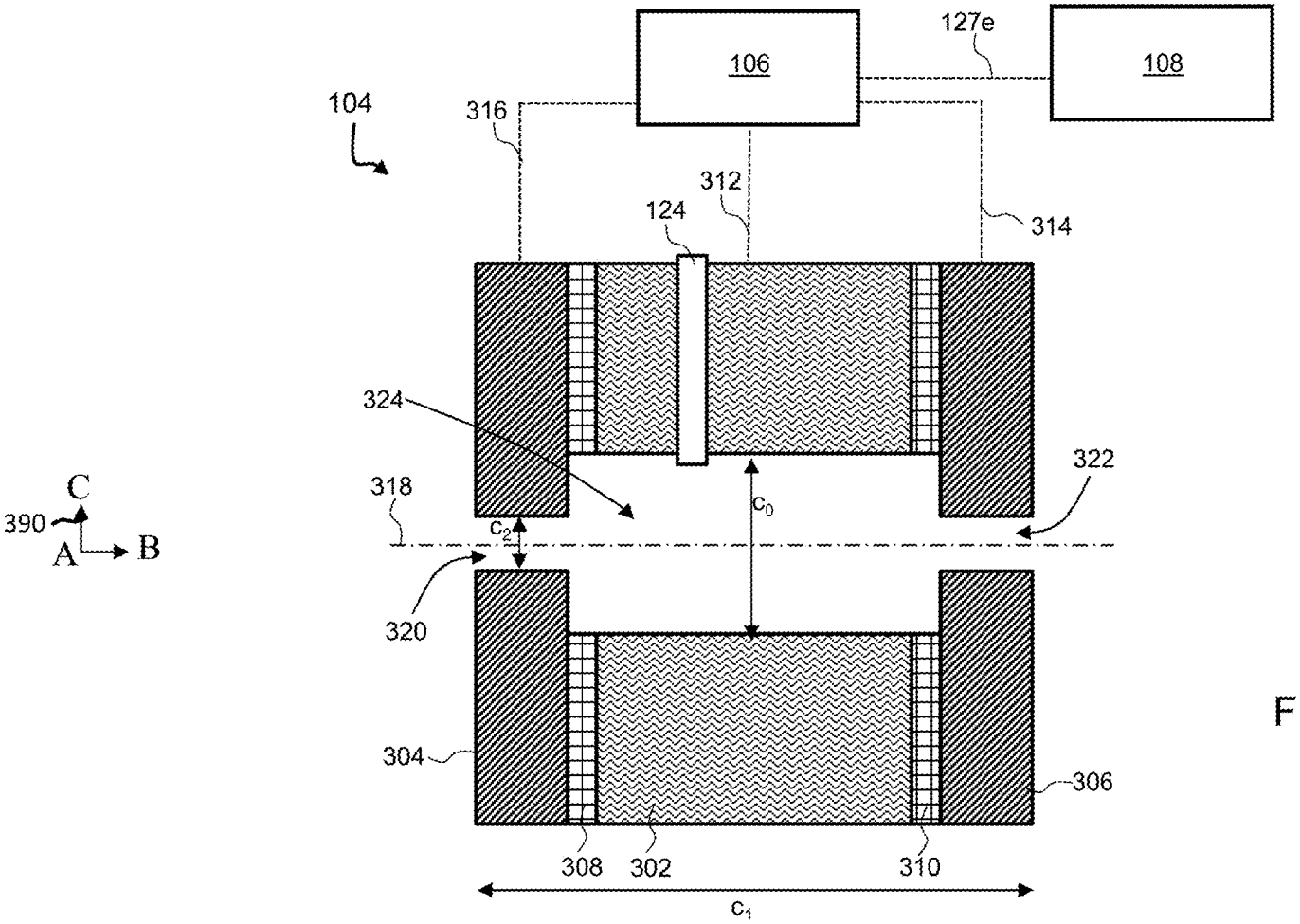
FIG. 3A is a cross-sectional diagram of an ion trap.

In contrast to typical conventional ion trap technologies, the mass spectrometers disclosed herein use compact, cylindrical ion traps for trapping and analyzing ions. FIG. 3A is a cross-sectional diagram of an embodiment of ion trap 104 according to coordinate 390. Ion trap 304 includes a cylindrical central electrode 302, two end cap electrodes 304 and 306, and two insulating spacers 308 and 310. Electrodes 302, 304, and 306 are connected to voltage source 106 via control lines 312, 314, and 316, respectively. Voltage source 106 is connected to controller 108 via control line 127*e*, controller 108 transmits signals to voltage source 106 via control line 127*e*, directing voltage source 106 to apply electrical potentials to the electrodes of ion trap 104.

During operation, ions generated by ion source 102 enter ion trap 104 through aperture 320 in electrode 304. Voltage source 106 applies potentials to electrodes 304 and 306 to create an axial field (e.g., symmetric about axis 318) within ion trap 104. The axial field confines the ions axially between electrodes 304 and 306, ensuring that the ions do not leave ion trap through aperture 320, or through aperture 322 in electrode 306. Voltage source 106 also applies an electrical potential to central electrode 302 to generate a radial confinement field within ion trap 104. The radial field confines the ions radially within the internal aperture of electrode 302.

With both axial and radial fields present within ion trap 104, the ions circulate within the trap. The orbital geometry of each ion is determined by a number of factors, including the geometry of electrodes 302, 304, and 306, the magnitudes and signs of the potentials applied to the electrodes, and the mass-to-charge ratio of the ion. By changing the amplitude of the electrical potential applied to central electrode 302, ions of specific mass-to-charge ratios will fall out of orbit within trap 104 and exit the trap through electrode 306, entering detector 118. Therefore, to selectively analyze ions of different mass-to-charge ratios, voltage source 106 (under the control of controller 108) changes the amplitude of the electrical potential applied to electrode 302 in stepwise fashion. As the amplitude of the applied potential changes, ions of different mass-to-charge ratio are ejected from ion trap 104 and detected by detector 118. In this way, positively and negatively charged particles can both be detected through the apertures 320 and 322 of ion trap 104.

In certain linear quadrupole mass spectrometry systems, ions generated by an ion source pass through a deflection lens that can deflect positive and negative ions in different directions. Such systems are different from the systems disclosed herein in that the ions are not trapped within a 3D ion trap, but merely deflected along a trajectory from the ion source to the detector by a 2D ion trap. In the systems and methods disclosed herein, ions generated by ion source 102 are confined in three dimensions within the ion trap 104, for trapping times from 0.01 ms to hundreds of milliseconds. During this period of confinement, the trapped ions circulate within ion trap 104.

Conventionally, trapping both positive and negative ions together in a single ion trap for at least the minimum trapping time disclosed above can lead to reactions of the positive and negative ions, making the detection of accurate mass spectral information difficult or even impossible. If reaction occurs between the positive and negative ions, the prospects for simultaneously detecting both types of ions are poor.

However, the systems and methods disclosed herein, in addition to maintaining a minimum trapping time of the ions within ion trap 104, also operate at high pressures (e.g., 100 mTorr to 100 Torr, as will be described in more detail subsequently) and at high radio frequencies for ion trap 104 (e.g., frequencies within a range from 5 MHz to 100 MHz). These high pressures, high frequencies, and the small volume of ion trap 104 ensure that positive and negative ions do not substantially react with one another while simultaneously trapped within ion trap 104. As a result, both positive and negative ions can be ejected from the trap and detected simultaneously.

Electrodes 302, 304, and 306 in ion trap 104 are generally formed of a conductive material such as stainless steel, aluminum, or other metals. Spacers 308 and 310 are generally formed of insulating materials such as ceramics, Teflon® (e.g., fluorinated polymer materials), rubber, or a variety of plastic materials.

The central openings in end-cap electrodes 304 and 306, in central electrode 302, and in spacers 308 and 310 can have the same diameter and/or shape, or different diameters and/or shapes. For example, in the embodiment shown in FIG. 3A, the central openings in electrode 302 and spacers 308 and 310 have a circular cross-sectional shape and a diameter $c_0$, and end-cap electrodes 304 and 306 have central openings with a circular cross-sectional shape and a diameter $c_2<c_0$. As shown in FIG. 3A, the openings in the electrodes and spacers are axially aligned along axis 318 so that when the electrodes and spacers are assembled into a sandwich structure, the openings in the electrodes and spacers form a continuous axial opening that extends through ion trap 104.

In general, the diameter $c_0$ of the central opening in electrode 302 can be selected as desired to achieve a particular target resolving power when selectively ejecting ions from ion trap 104, and also to control the total internal volume of spectrometer 100. In some embodiments, $c_0$ is approximately 0.6 mm or more (e.g., 0.8 mm or more, 1.0 mm or more, 1.2 mm or more, 1.4 mm or more, 1.6 mm or more, 1.8 mm or more). The diameter $c_2$ of the central opening in end-cap electrodes 304 and 306 can also be selected as desired to achieve a particular target resolving power when ejecting ions from ion trap 104, and to ensure adequate confinement of ions that are not being ejected. In certain embodiments, $c_2$ is approximately 0.25 mm or more (e.g., 0.35 mm or more, 0.45 mm or more, 0.55 mm or more, 0.65 mm or more, 0.75 mm or more).

The axial length $c_1$ of the combined openings in electrode 302 and spacers 308 and 310 can also be selected as desired to ensure adequate ion confinement and to achieve a particular target resolving power when ejecting ions from ion trap 104. In some embodiments, $c_1$ is approximately 0.6 mm or more (e.g., 0.8 mm or more, 1.0 mm or more, 1.2 mm or more, 1.4 mm or more, 1.6 mm or more, 1.8 mm or more).

It has been determined experimentally that the resolving power of spectrometer 100 is greater when $c_0$ and $c_1$ are selected such that $c_1/c_0$ is greater than 0.83. Therefore, in certain embodiments, $c_0$ and $c_1$ are selected so that the value of $c_1/c_0$ is 0.8 or more (e.g., 0.9 or more, 1.0 or more, 1.1 or more, 1.2 or more, 1.4 or more, 1.6 or more).

To overcome limitations on the number of ions that can simultaneously be trapped in ion trap 104 and increase the capacity of spectrometer 100, in some embodiments, spectrometer 100 can include an ion trap with multiple chambers. FIG. 3B shows a schematic diagram of an ion trap 104 with a plurality of ion chambers 330, arranged in a hexagonal array according to coordinate 392. Each chamber 330 functions in the same manner as ion trap 104 in FIG. 3A, and includes two end cap electrodes and a cylindrical central electrode. End cap electrode 304 is shown in FIG. 3B, along with a portion of end-cap electrode 306. End cap electrode 304 is connected to voltage source 106 through connection point 334, and end cap electrode 306 is connected to voltage source 106 through connection point 332.

Figure 3C:
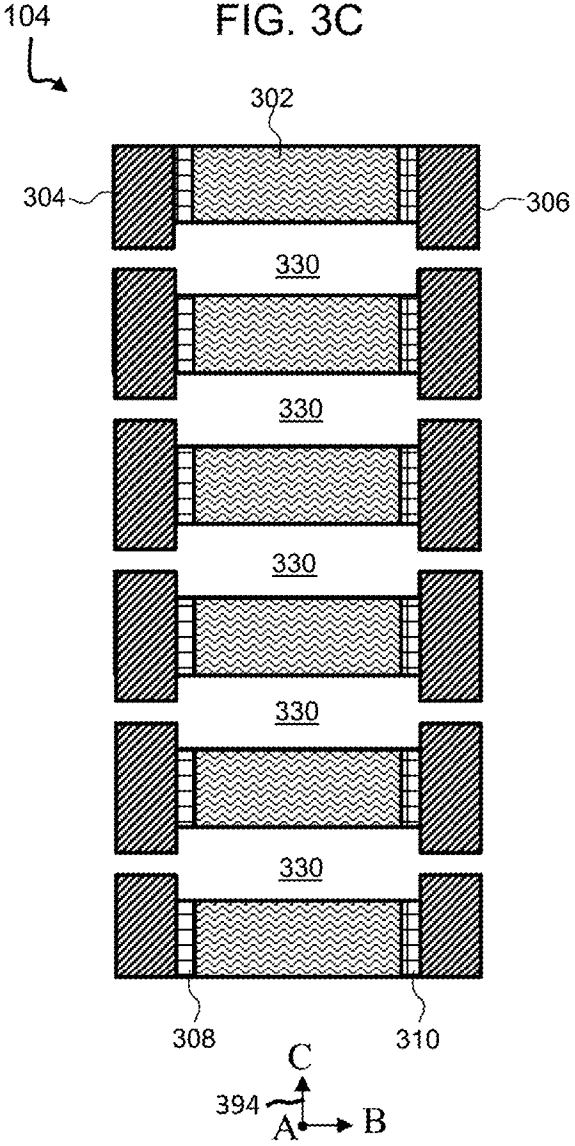
FIG. 3C is a cross-sectional diagram of the ion trap shown in FIG. 3B at a different perspective.
Figure 3B:
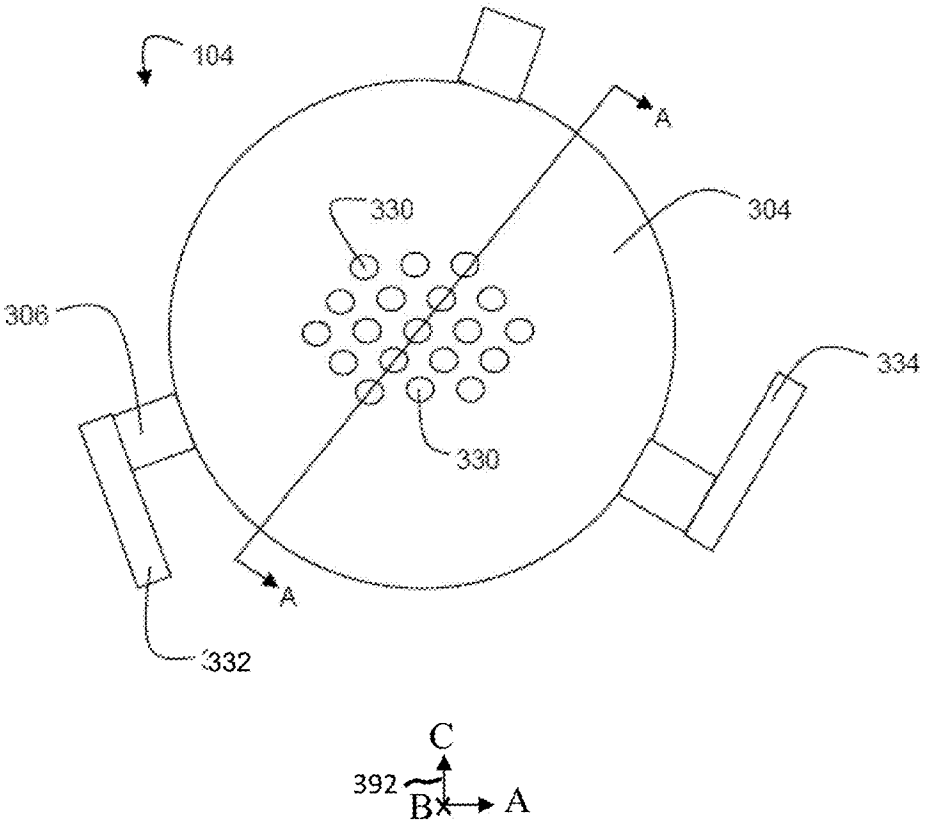
FIG. 3B is a schematic diagram of an ion trap with a plurality of ion chambers.

FIG. 3C is a cross-sectional diagram through section line A-A in FIG. 3B, according to coordinate 394. Each of the five ion chambers 330 that fall along section line A-A is shown. Voltage source 106 is connected via a single connection point (not shown in FIG. 3C) to central electrode 302. As a result, by applying suitable potentials to electrode 302, voltage source 106 (under the control of controller 108) can simultaneously trap ions within each of the chambers 330, and eject ions with selected mass-to-charge ratios from each of the chambers 330.

In some embodiments, the number of ion chambers 330 in ion trap 104 can be matched to the number of apertures formed in end cap electrode 304 of an ion source. When end cap electrode 304 includes a plurality of apertures, ion trap 104 can also include a plurality of ion chambers 330, so that each aperture formed in end cap electrode 304 corresponds to a different ion chamber 330 to that ions generated by ion source 102 can be efficiently collected by ion trap 104, and trapped within ion chambers 330. The use of multiple chambers reduces space-charge interactions among the trapped ions, increasing the trapping capacity of ion trap 104. The positions and cross-sectional shapes of ion chambers 330 can be the same as the arrangements and shapes of apertures 240 and 294 of the ion source.

Additional features of ion trap 104 are disclosed, for example, in U.S. Pat. No. 6,469,298, in U.S. Pat. No. 6,762,406, and in U.S. Pat. No. 6,933,498, the entire contents of each of which are incorporated herein by reference.

Detector Subsystem

Spectrometer 100 includes detector subsystem 119 that is configured to collect charged particles ejected from ion trap 104 as described above. The charged particles can be positive ions, negative ions, electrons, or a combination of these particles. The detector subsystem 119 can include one or more detectors 118. Different detectors 118 can be biased to collect charged particles with different signs. In some embodiments, a detector 118 can include a plurality of detector elements that are biased to collect charged particles with different signs.

A wide variety of different detectors can be used in spectrometer 100. In some embodiments, one detector can be used to collect charged particles with a given sign (positive or negative) at a given time. The systems disclosed herein can include detector subsystems capable of collecting both positively and negatively charged particles at the same time.

Figure 4A:
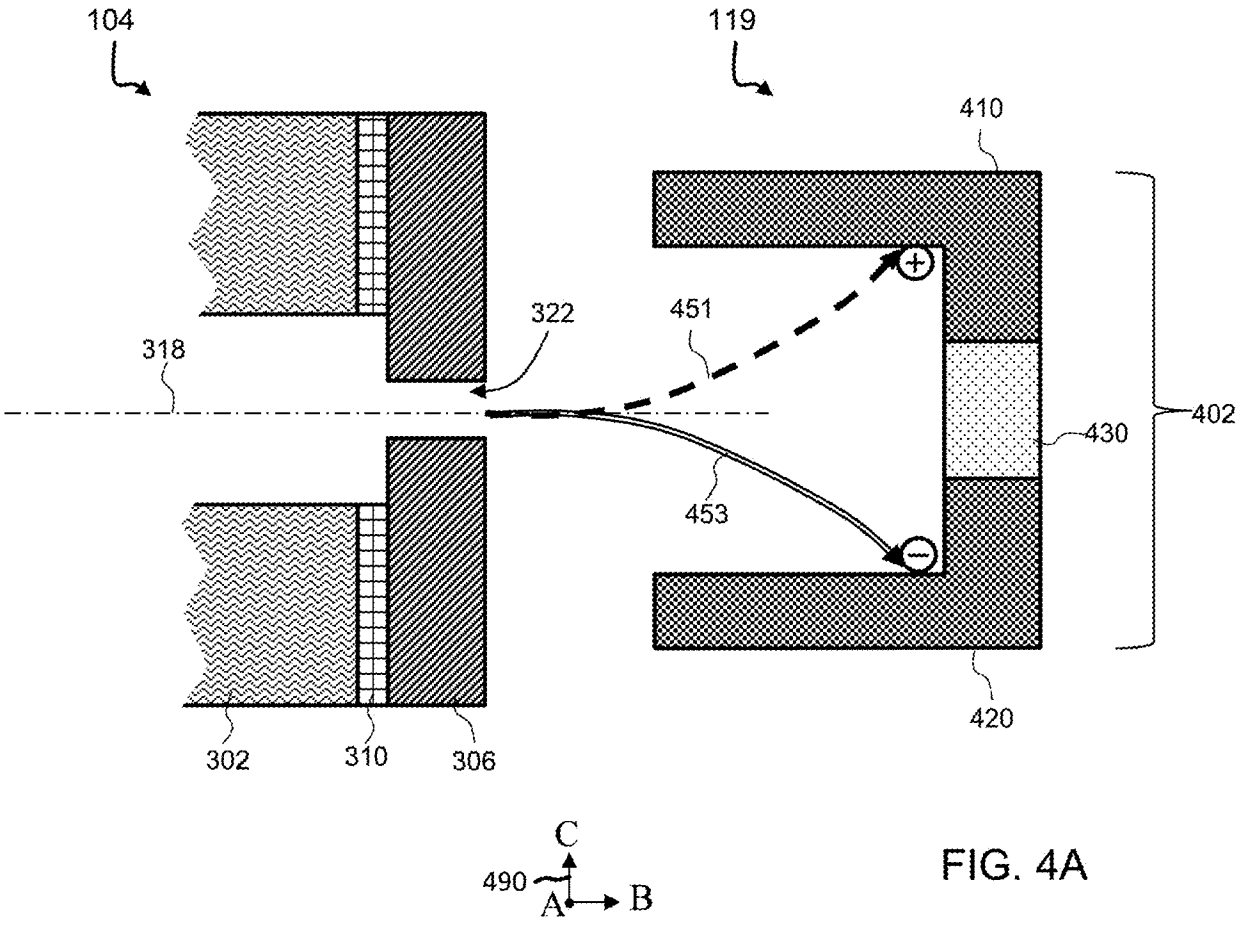
FIG. 4A is a schematic diagram of an ion trap and a detector subsystem.

FIG. 4A is a schematic diagram of an example configuration of ion trap 104 and detector subsystem 119 that includes a Faraday cup 402 according to coordinate 490. The ion trap 104 has features and properties similar to those described above in connection with FIG. 3A. In this example, the Faraday cup 402 has a circular base with its rotational axis parallel to the B-direction. Generally, the Faraday cup 402 need not have a circular base, but can have a variety of cross-sectional shapes, including square, rectangular, elliptical, circular, or any other regular or irregular shape. Base 402 can be flat or curved, for example.

In general, the Faraday cup 402 can relatively small. The maximum dimension of Faraday cup 402 corresponds to the largest linear distance between any two points on the cup. In some embodiments, for example, the maximum dimension of Faraday cup 402 is 30 mm or less (e.g., 20 mm or less, 10 mm or less, 5 mm or less, 3 mm or less). The Faraday cup 402 can be formed from one or more metals such as copper, aluminum, and silver.

During operation of spectrometer 100, charged particles are ejected from aperture 322 of ion trap 104 as described above. These ejected charged particles can include both positively and negatively charged particles, which can drift or be accelerated by electric field towards the detection subsystem 119 positioned after the aperture 320. For example, the relative electric potential between end cap electrode 306 and detector elements of the detection subsystem 119 can provide an electric field distribution which guides the charged particles. Referring to FIG. 4A as an example, electrode 410 of the Faraday cup 402 is biased at an electric potential lower than the electric potential of electrode cap 306. Electrode 420 of the Faraday cup 402 is biased at an electric potential higher than the electric potential of electrode cap 306. Electrical insulator 430 is positioned between electrodes 410 and 420 to electrically insulate these two electrodes from each other. In some embodiments, electrical insulator 430 can include materials such as ceramics, rubber, Teflon®, etc. With these biased electric potentials of the electrodes, positively charged particles are attracted towards electrode 410 (as shown by trajectory of dash line 451) while being repelled from electrode 420. On the other hand, negatively charged particles are attracted toward electrode 420 (as shown by trajectory of double-solid line 453) while being repelled from electrode 410. As such, the Faraday cup 402 is capable of collecting positively and negatively charged particles at the same time through electrodes 410 and 420, respectively. Such collection can be achieved when the relative electrical potentials between cap electrode 306, electrode 410, and electrode 420 are set as described above. Any one of these electrodes can be set to ground potential.

The positively charged particles captured by electrode 410 generate an electrical signal (e.g., electric current), which can be measured by circuitry within detector subsystem 119 or sent to controller 108. Separately, negatively charged particle captures by electrode 420 generate an electrical signal (e.g., electric current), which is also measured by circuitry with the detector subsystem or sent to controller 108. If the charged particles are positive and negative ions, the measured currents are ion currents (also referred as "positive ion currents" and "negative ion currents" herein), and their amplitude is proportional to the abundance of the measured positive and negative ions, respectively. The generated electrical signals can be used to determine information about sample particles introduced into ion trap 104.

To obtain mass spectral information for an analyte, the amplitude of the electrical potential applied to central electrode 302 of ion trap 104 is varied (e.g., a variable amplitude signal, high voltage RF signal 482, is applied) to selectively eject ions of particular mass-to-charge ratios from ion trap 104. For each change in amplitude corresponding to a different mass-to-charge ratio, an ion current corresponding to ejected ions of the selected mass-to-charge ratio is measured using detector elements of the detector subsystem 119. The measured ion current as a function of the potential applied to electrode 302—which corresponds to the mass spectrum—is reported to controller 108. In some embodiments, controller 108 converts applied voltages to specific mass-to-charge ratios based on algorithms and/or calibration information for ion trap 104.

Two mass spectra can be obtained by measuring both positive and negative ion currents—one spectrum from the positive ion current and one spectrum from the negative ion current. The measurement of two spectra can provide various advantages in improving the analysis of sample particles. For example, for some sample particles, the two mass spectra can be different. Thus, the information in both spectra can serve as a signature for such sample particles, thereby improving the analysis of sample particles. Moreover, by collecting both positively and negatively charged particles at the same time, the data acquisition time can be reduced, for example, by approximately one half, leading to higher throughput during sample analysis. Methods of operation will be described in more detail later in this disclosure.

Figures 4B, 4C, 4D, 4E, 4F, 4G:
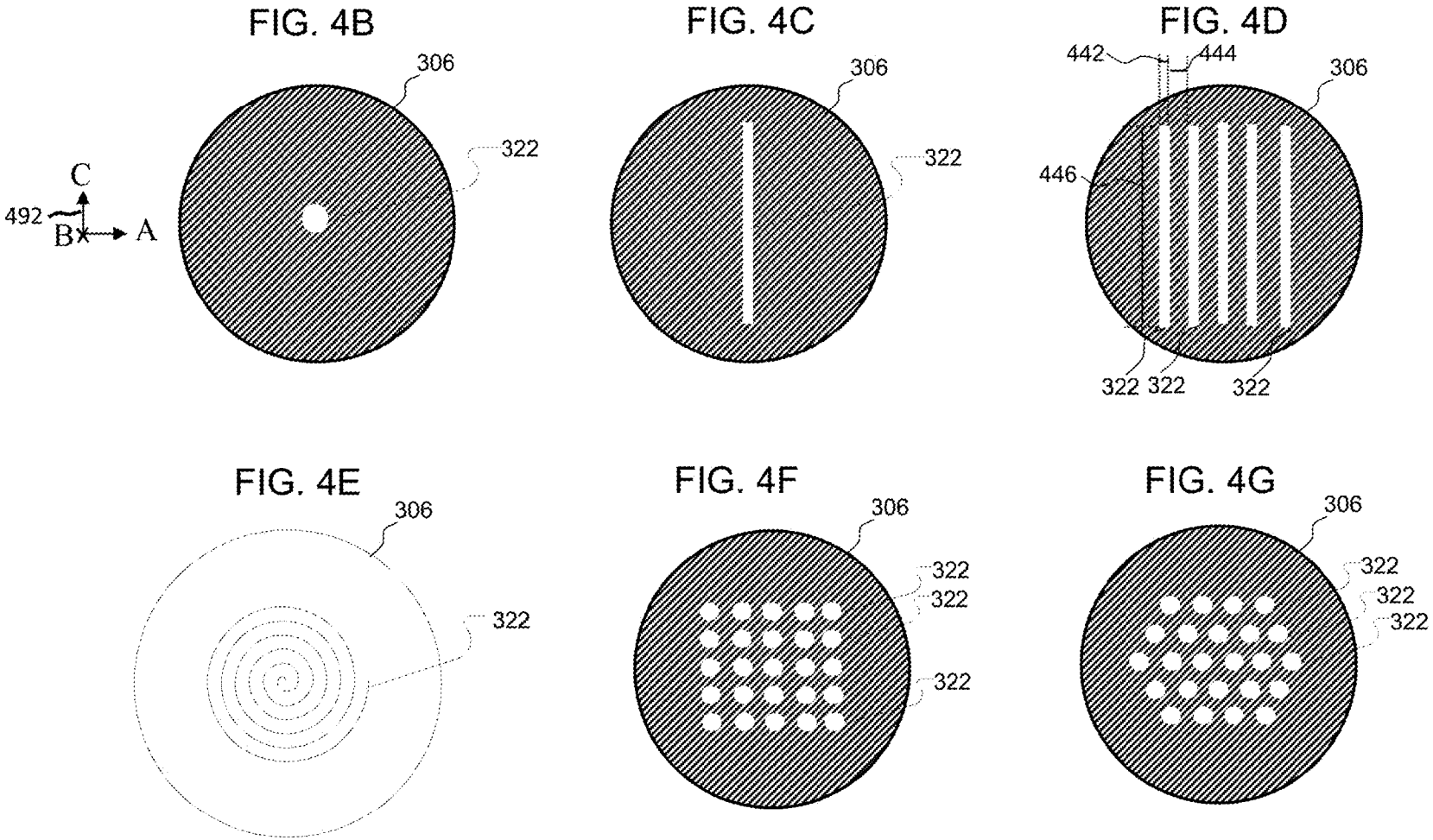
FIG. 4B is a schematic diagram of an electrode of the ion trap shown in FIG. 4A.
FIGS. 4C-4G are schematic diagrams of electrodes of ion traps having different aperture shapes and/or arrangements.

FIGS. 4B-4G are schematic diagrams of examples of end cap electrode 306 according to coordinate 492. Referring to FIG. 4B, the electrode 306 shown in FIG. 4A is depicted in a different perspective. In this example, electrode 306 has aperture 322 of a circular shape. FIG. 4C shows an example of electrode 306 having an aperture 322 shaped as a slit. FIG. 4D shows an example of electrode 306 with a plurality of apertures 322, each shaped as a slit. In some embodiments, the width 442 of a slit can be 0.9 mm or less (e.g., 0.7 mm or less) and edge-to-edge distance 444 between adjacent apertures 322 can be 0.9 mm or less (e.g., 0.7 mm or less). In some embodiments, the length 446 of different aperture 322 can vary between 4 mm to 10 mm.

FIG. 4E shows an example of electrode 306 with an aperture 322 shaped as a spiral. Here, the opening of aperture 322 is shown with solid lines for simplicity. FIG. 4F shows an example of electrode 306 with a plurality of apertures 322 arranged as a rectangular array. For example, diameters of circular apertures can be 1 mm or less (e.g., 0.9 mm or less, 0.8 mm or less.) FIG. 4G shows an example of electrode 306 with a plurality of apertures 322 arranged in a hexagonal array. The embodiments shown in FIGS. 4B-4G are only examples of a wide variety of different arrangements of apertures having different cross-sectional shapes (e.g., square, rectangular, elliptical, etc.) and sizes that can be used in electrode 306. In some embodiments, aperture 320 of electrode 304 and the shape of ion chamber 330 can be congruent to the shape of aperture 322 of electrode 306. Moreover, although the perimeter of electrode 306 shown in FIGS. 4B-4G is circular, in other embodiments, the perimeter can have different shapes such as, for example, rectangular, pentagonal, and hexagonal.

Figure 5B:
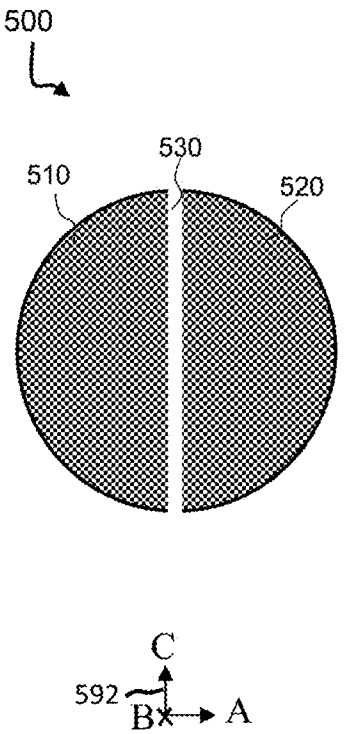
FIG. 5B is a schematic diagram of the detector subsystem shown in FIG. 5A at another perspective.
Figure 5A:
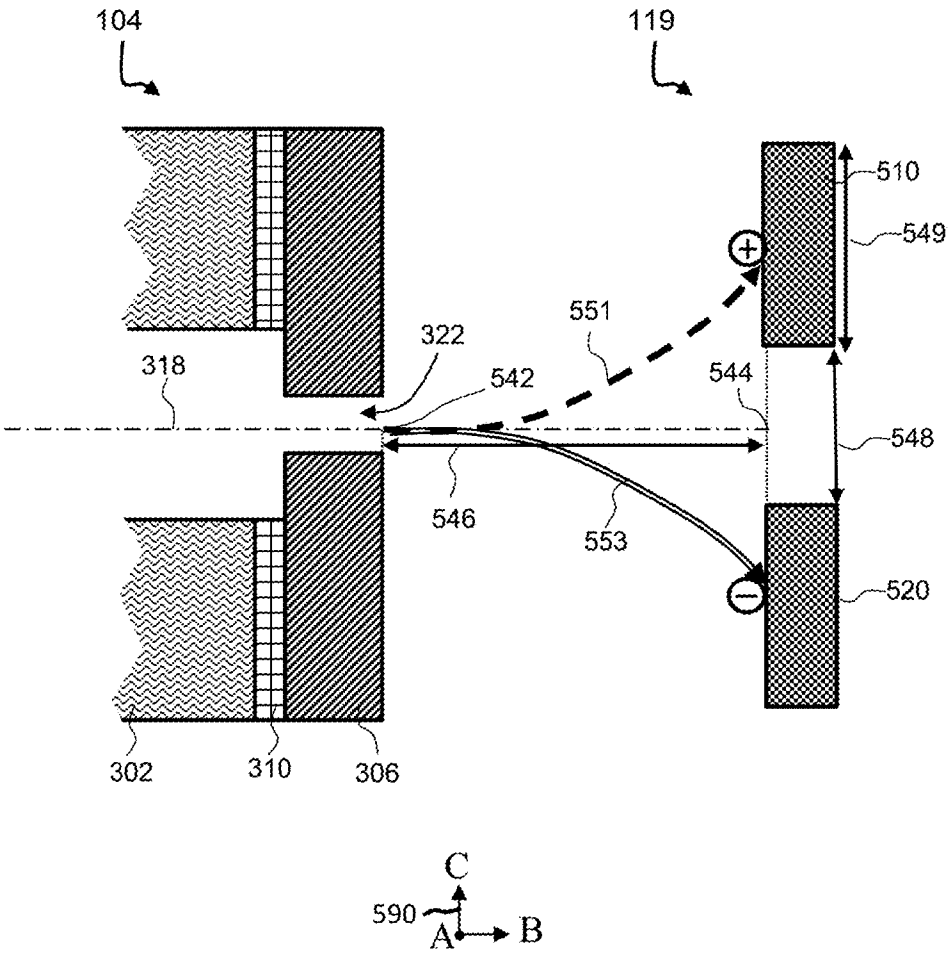
FIG. 5A is a schematic diagram of another example of an ion trap and a detector subsystem.

FIG. 5A is a schematic diagram of another example configuration of ion trap 104 and a detector subsystem 119 according to coordinate 590. The detection subsystem 119 includes two electrodes 510 and 520. In a manner similar to the example described in relation to FIG. 4A, controller 108 applies to electrode 520 an electrical voltage higher than that applied to end cap electrode 306, and applies to electrode 510 an electrical voltage lower than that applied to end cap electrode 306. Accordingly, electrode 520 is biased at a higher electric potential than end cap electrode 306, which is biased at a higher electric potential than electrode 510. In this configuration, electrode 510 attracts and receives positively charged particles ejected through aperture 322 (as shown by trajectory of dash line 551), and electrode 520 attracts and receives negatively charged particles ejected through aperture 322 (as shown by trajectory of double-solid line 553). FIG. 5B is a schematic diagram of the detector subsystem 119 shown in FIG. 5A at a different perspective according to coordinate 592. Electrode 510 is shaped as a semi-circle and electrode 520 is shaped as a semi-circle. Electrical insulator 530 (not shown in FIG. 5A) is positioned between the two electrodes so as they are not short-circuited. Generally, electrical insulator 530 can be formed from materials such as ceramics, rubber, Teflon®, and/or oxide substrates.

Aperture 322 can be referred to as a "common aperture" where both positively and negatively charged particles emerge from ion trap 104. At the exit surface where center point 542 lies, the ejected particles can be traveling directions that differ from each other within an angle of 7° or less (e.g., 5° or less, 3° or less, 1° or less.) The ejected charged particles are guided by electric fields generated by the electrical potential differences between electrodes 306 and detector elements of detector subsystem 119.

Referring again to FIG. 5A, center point 542 of the exit surface of aperture 322 has a distance 546 from center point 544, which is located at a center between edges of electrodes 510 and 520. Center point 544 lies in a line extending between the front surfaces of electrodes 510 and 520. In this example, the line coincides with axis 318. In some embodiments, distance 546 is 1 mm or less (e.g., 0.9 mm or less, 0.8 mm or less). In certain embodiments, distance 546 is in a range between 0.94 mm and 1 mm.

In some embodiments, the edge-to-edge distance 548 between electrodes 510 and 520 can be 1 mm or less (e.g., 0.9 mm or less, 0.8 mm or less, 0.7 mm or less, 0.6 mm or less, 0.5 mm or less, 0.4 mm or less). The width 549 of electrode 510 can be 1 mm or less (e.g., 0.9 mm or less, 0.8 mm or less, 0.7 mm or less, 0.6 mm or less, 0.5 mm or less, 0.4 mm or less). The width of electrode 520 can have a value as described for the width of electrode 510. While in some embodiments the widths of electrodes 510 and 520 are the same, more generally the widths of electrodes 510 and 520 can be different. The small size of ion trap 104 and detector subsystem 119 provides a compact volume where charged particles travel a small distance from the ion trap 104 to the detector subsystem 119.

Figure 5C:
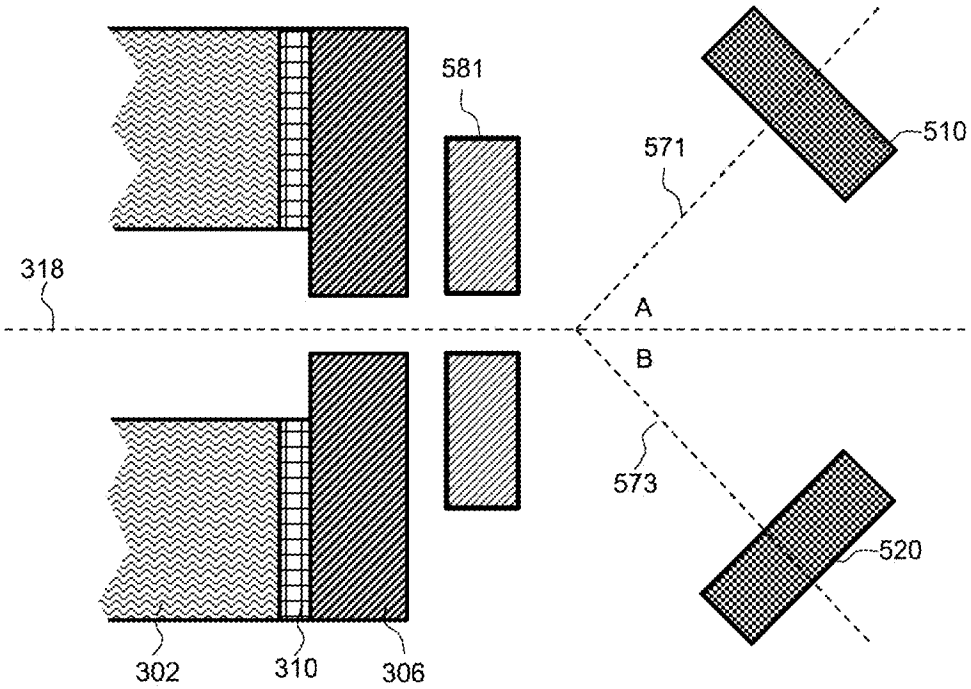
FIG. 5C is a schematic diagram of a further example of an ion trap and a detector subsystem.

In some embodiments, electrodes 510 and/or 520 can be oriented at an angle with respect to the central axis 318 of ion trap 104. FIG. 5C shows an embodiment in which the detector subsystem 119 includes angled electrodes. In FIG. 5C, surface normal 571 and 573 extending from the surfaces of electrodes 510 and 520 are oriented at angles A and B with respect to axis 318. In certain embodiments, A and B are the same. In some embodiments, however, A and B are different. For example, when different bias voltages are applied to electrodes 510 and 520, the angles A and B can be different and/or the distances of electrodes 510 and 520 from axis 318—measured along axes 571 and 573, respectively—can be different.

In general, electrodes 510 and/or 520 can be oriented at a wide range of angles with respect to axis 318. For example, A and/or B can be 5 degrees or more (e.g., 10 degrees or more, 20 degrees or more, 30 degrees or more, 40 degrees or more, 60 degrees or more, 75 degrees or more).

Figure 6A:
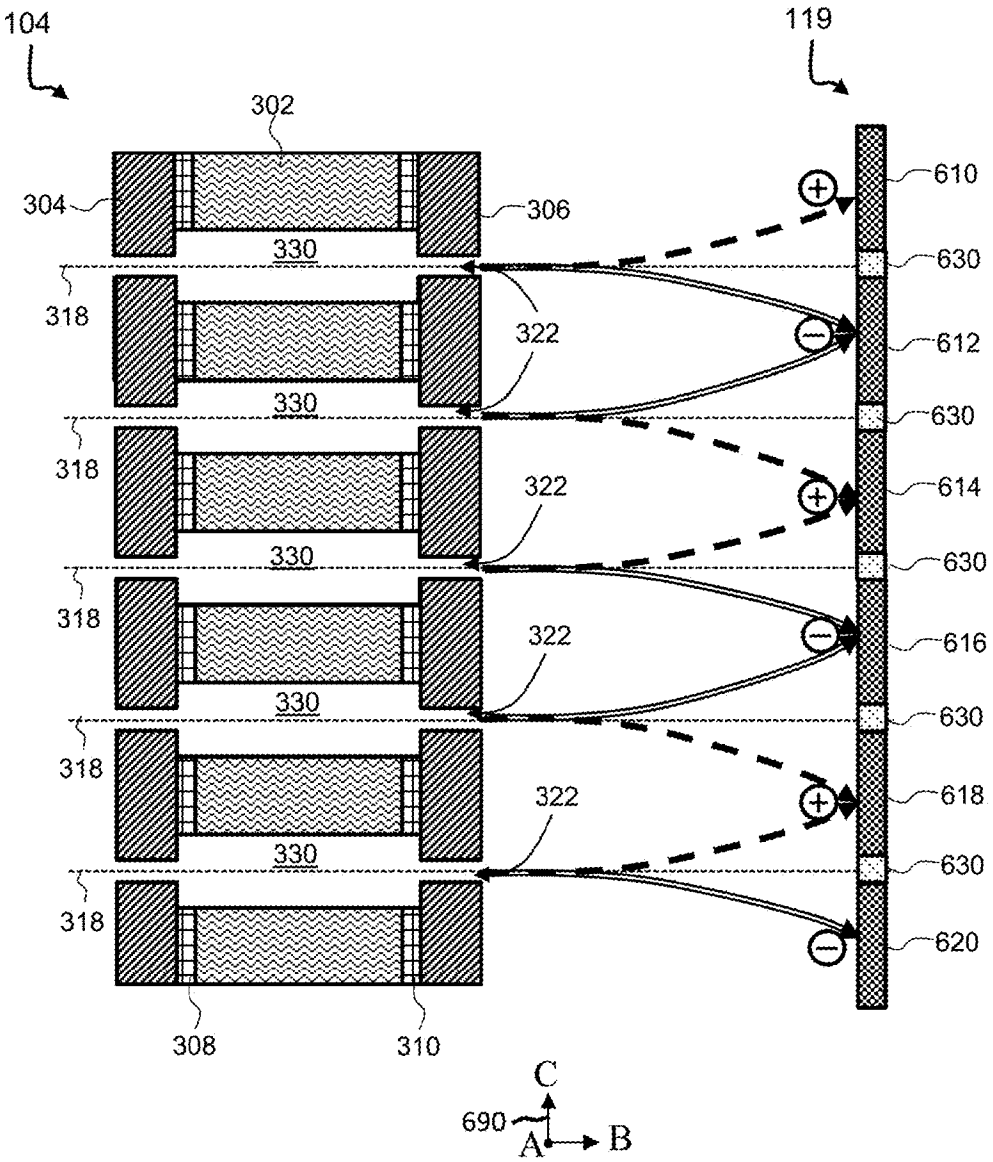
FIG. 6A is a schematic diagram of a detector subsystem.

As described in relation to FIGS. 3B and 3C, in some embodiments, ion trap 104 has multiple ion chambers 330. For such an ion trap 104, FIG. 6A is a schematic diagram of an example configuration including a detector subsystem 119 to collect charged particles ejected from the ion trap 104 according to coordinate 690. The illustrated configuration shows how positively and negatively charged particles are collected by electrodes of the detector subsystem 119 using dashed lines and double-solid lines similar to FIGS. 4A and 5A. The detector subsystem 119 includes a plurality of electrodes 610-620 with electrical insulator 630 between the electrodes. The electrodes 610-620 and electric insulators 630 are arranged such that the electrical insulators 630 lie on axes 318 of each ion chamber 330. In this way, adjacent electrodes are symmetric with respect to axes 318.

In this example, each axis 318 passes through the center of respective aperture 422 and passes through the center point between two electrodes. For example, axis 318 of ion chamber 330 on the top most part of FIG. 6A in the C-direction passes through the center of aperture 322, the center point between electrodes 610 and 612, and electrical insulator 630. The electrodes 610 and 612 are positioned symmetrically with respect to that axis 318. In certain embodiments, the controller applies the electrical voltages to the electrodes 610 and 612 so that the magnitude of the electric field distribution generated by the electrodes 610 and 612 are symmetric with respect the axis 318.

During operation, ion trap 104 can eject charged particles through apertures 322. Electrodes 610, 614, and 618 are biased at a lower electric potential than end cap electrode 306. Electrodes 612, 616, and 620 are biased at a higher electric potential than end cap electrode. Thus, positively charged particles are attracted to and received by electrodes 610, 614, and 618, while negatively charged particles are attracted to and received by electrodes 612, 616, and 620. Using multiple chambers 330 can reduce space-charge interactions among the trapped ions and increase the trapping capacity of ion trap 104. Further, the electrodes 610-620 are aligned symmetric with respect to axes 318 so that positively and negatively charged particles have a similar trajectories with respect axes 318. This allows the charged particles ejected from different apertures 322 to travel similar minimum distances. Accordingly, the electrodes 610-612 can efficiently collect the charged particles without significant loss of particles that travel longer distances than other particles.

FIG. 6B is a schematic diagram showing the detector subsystem 600 of FIG. 6A at a different perspective according to coordinate 692. FIG. 6C shows a cross-sectional diagram of a portion of the detector subsystem 119 along section line B-B indicated in FIG. 6B. For purposes of illustration, FIG. 6B shows six electrodes 610-620 (although more generally, any number of electrodes can be implemented). The dashed boxes shown between electrodes 610-620 indicate the outlines of apertures 322, which are displaced in the negative B-direction. In some embodiments, the number of electrodes can be selected depending on the number of ion chambers. For example, the number of electrodes can be selected so that at least two pairs of electrodes can be arranged symmetrically with respect to an aperture 322 of the ion trap 104.

In the example shown in FIG. 6B, straight electrode stripes are arranged in a row with electrical insulator 630 positioned between adjacent electrode stripe. As describe in relation to FIG. 6A, electrodes 610, 614, and 618 form a first subset of electrodes that are biased at a lower electric potential than cap electrode 306 to attract positively charged particles, and electrodes 612, 616, and 620 form a second subset of electrodes that are biased at a higher potential than cap electrode 306 to attract negatively charged particles. When cap electrode 306 is biased to ground potential of 0V, electrodes 610, 614, and 618 can be negatively biased and electrodes 612, 616, and 620 can be positively biased. Accordingly, the electrode stripes can be biased to have alternating polarities.

In general, detector elements such as electrodes of a detector subsystem 119 can have various shapes and arrangements. FIG. 6C is a schematic diagram of another example of a detector subsystem 660 according to coordinate 692. The electrodes are shaped and arranged as concentric rings (also referred as "electrode rings"). To detect positively and negative charged particles at the same time, electrode rings are biased at an alternating manner so that every other electrode ring attracts and collects the same sign of charged particles. In this example, electrodes 650, 654, and 658 are biased to attract positively charged particles, and electrodes 652 and 656 are biased to attract negatively charged particles. Electrical insulators 630 are positioned between the electrode rings to prevent shorting between adjacent electrodes. For example, electrical insulator 630 prevents shorting between electrode 650 and 652.

In general, a variety of different ring shapes can be used. For example, when aperture 322 has a circular cross-sectional shape, circular rings can be used, as shown in FIG. 6C. As another example, when aperture 322 has a spiral shape as shown in FIG. 4E, the electrodes can have spiral shapes and/or circular ring shapes.

Figure 7B:
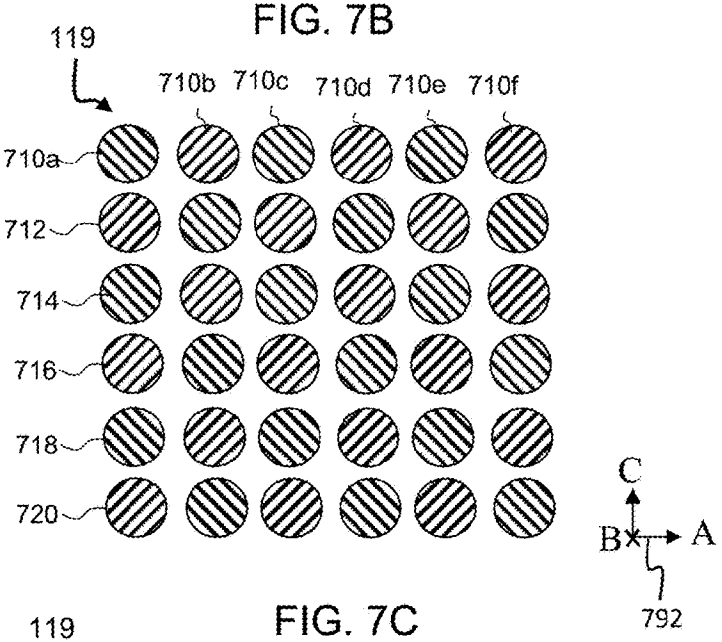
FIGS. 7B and 7C are schematic diagrams of the detector subsystem shown in FIG. 7A.
Figure 7C:
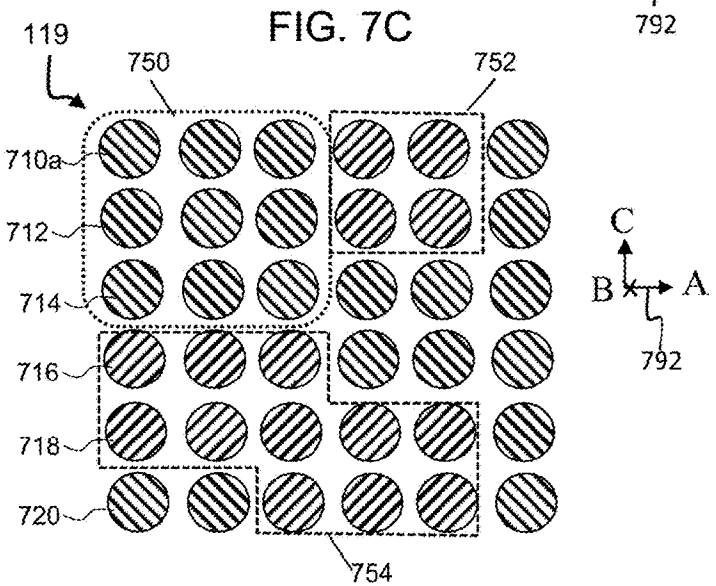
Figure 7A:
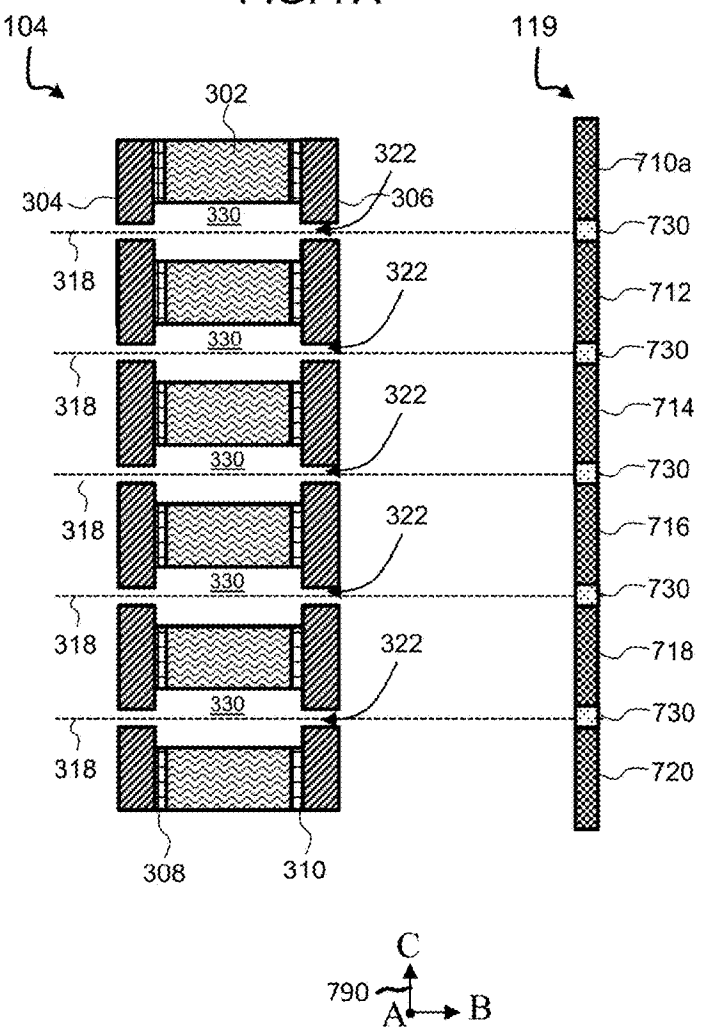
FIG. 7A is a cross-section diagram of an ion trap and a detector subsystem.

In some embodiments, ion trap 104 includes a two-dimensional array of ion chambers 330 and a two-dimensional array of apertures 322 such as in FIGS. 4F and 4G. To effectively collect charged particles ejected from each aperture 322 in the 2D array, the detector subsystem can include a two-dimensional array of detector elements. FIGS. 7A-7C are schematic diagrams illustrating such a configuration. FIG. 7A is a cross-section diagram of an ion trap 104 according to coordinate 790. The ion trap 104 includes a 5×5 array of ion chambers in the A-C plane. Detector subsystem 119 includes a 6×6 array of electrodes in the A-C plane. FIG. 7A shows electrodes 710*a* and 712-720 arranged in the C-direction. Electrical insulators 730 are positioned between adjacent electrodes and aligned with apertures 322 so that axes 318 pass through the mid-points between adjacent electrodes. In this example, the array of electrodes is larger in each two-dimensional direction than the array of ion chambers. Generally, ion trap 104 can include any numbers of ion chambers 330, and the 5×5 array is only an example. Similarly, detector subsystem 700 can include any number of electrodes, and the 6×6 is array is only an example. Further, in general, the dimensions of the array of electrodes can be smaller than, the same as, or larger than the dimensions of the array of ion chambers. Either (or both) arrays can be square (as illustrated), or can have another shape (e.g., rectangular).

FIG. 7B is a schematic diagram of the detector subsystem 119 shown in FIG. 7A at a perspective according to coordinate 792. The 6×6 array of electrodes are arranged in the A-C plane. In this example, the electrodes are biased in an alternating manner. Electrode 710*a* and other electrodes in the figure with the same cross-hatching pattern are biased to collect positively charged particles. For instance, electrodes 714, 718, 710*c*, and 710*e* have the same bias electric potential as that of electrode 710*a*. On the other hand, electrode 712 and other electrodes with the same cross-hatching pattern in the figure are biased to collect negatively charged particles. For instance, electrodes 716, 720, 710*b*, 710*d*, and 710*f* have the bias electric potential as that of electrode 712. As shown, pairs of nearest neighbor electrodes are biased to attract oppositely charged particles. This configuration can be advantageous in that every aperture 322 is aligned symmetrically between two electrodes which are oppositely biased relative to cap electrode 306. Accordingly, the charged particles ejected from different apertures 322 travel the same minimum distance due to the symmetric arrangement to be detected, and the electrodes can efficiently collect both the positively and negatively charged particles without loss of particles that travel longer distances than other particles.

In some embodiments, the plurality of electrodes of detector subsystem 119 can be grouped together to form subsets of electrode that collectively receive particles with charges of the same sign. FIG. 7C is a schematic diagram of the detector subsystem 119 shown in FIG. 7A at a perspective according to coordinate 792, but with a different bias setting from that of FIG. 7B. In this example, controller 108 applies electrical voltages to electrodes in subset 750 so that each electrode in subset 750 receives positively charged particles. Controller 108 applies electrical voltages to electrodes in subsets 752 and 754 so that each electrode in these subsets receives negatively charged particles. Such groupings can be advantageous when ion trap 104 is replaced with another ion trap having, for example, a different shape and/or distribution of apertures 322. Thus, reconfiguring the distribution of potentials applied to each of the electrodes to effect grouping of the electrodes into subsets that detect particles of the same charge sign can be used to adapt to different arrangements of apertures 322 that are present in different ion traps 104. Controller 108 can use information about ion trap 104 entered by a user of the system, or information about ion trap 104 detected automatically when ion trap 104 is introduced into the system (or retrieved from a system storage unit) to automatically re-configure the pattern of bias potentials applied to each of the electrodes to define subsets of electrodes suitable for a particular ion trap 104.

Moreover, in some measurements, gas particles can include several types of sample particles which are not evenly distributed in the ion chambers 330 of ion trap 104. That is, positively charged particles may be preferentially concentrated in certain ion chambers, while negatively charged particles may be preferentially concentrated in other ion chambers. For such samples, grouping detector elements such one or more groups of elements are configured to detect positively charged particles, and/or one or more groups of elements are configured to detect negatively charged particles, and/or one or more groups of elements are configured to detect both positively and negatively charged particles, can improve detection efficiency and signal-to-noise ratio. Controller 108, by receiving information from a user of the system and/or by retrieving stored information about the sample from a data storage unit, can configure patterns of bias potentials suitable for defining groups of detection elements in this manner.

Figure 7E:
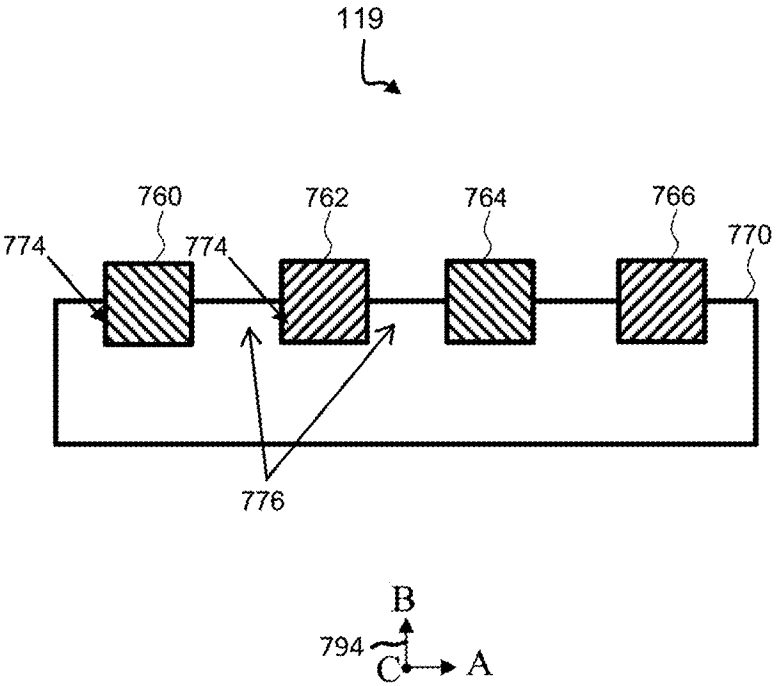
FIGS. 7D and 7E are cross-sectional diagrams of detector subsystem.
Figure 7D:
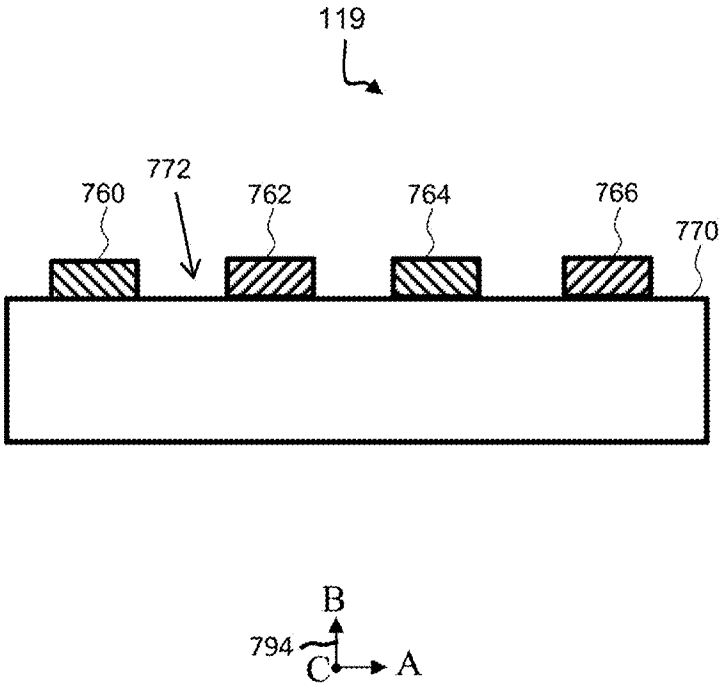

A variety of methods can be used to manufacture detector subsystem 119. FIGS. 7D and 7E are schematic diagrams of examples of detector subsystems 119 according to coordinate 794. In FIG. 7D, electrodes 760-766 are positioned on a surface of substrate 770. For example, substrate 770 can be an electrically insulating oxide substrate. In this example, region 772 has no solid material, and functions as an insulating medium between the electrodes.

In FIG. 7E, electrodes 760-766 are positioned in recesses 774 formed in substrate 770, which can be an oxide substrate. For example, the recesses can be formed by chemical or reactive ion etching in the substrate, and/or by mechanical milling. Regions 776 of the substrate correspond to electrical insulators that prevent current flow between the electrodes.

Generally, substrate 770 can be made from electrically insulating material such as ceramics, Teflon®, rubber, plastics, various semiconductor oxide materials, and various semiconductor nitride materials. Electrodes can be formed by milling metal (e.g., copper, silver, aluminum, gold) plates and gluing the metal to substrate 770. The metal can be in contact with substrate 770. In some embodiments, the electrodes can be formed using a variety of deposition techniques including chemical vapor deposition and physical vapor deposition onto substrate 770. In certain embodiments, techniques employed in printed circuit board fabrication, including photolithographic processes (e.g., deposition, exposure, and development of photoresist materials) and laser ablation, can be used to apply the electrodes to substrate 770.

Figure 8B:
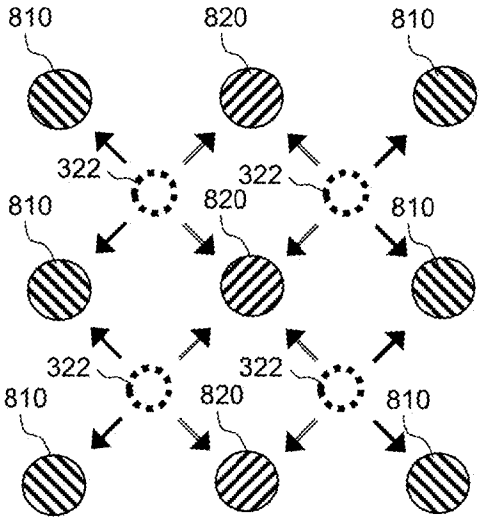
FIGS. 8A-8C are schematic diagrams showing relative arrangement of electrodes of detector subsystems and apertures of ion traps.
Figure 8A:
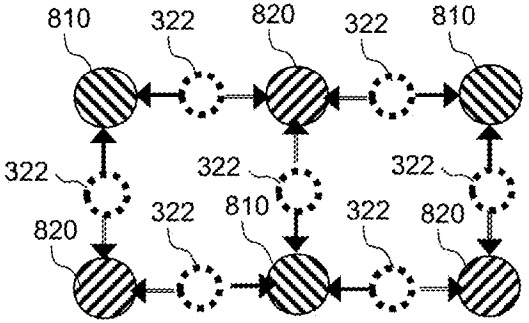
Figure 8A:
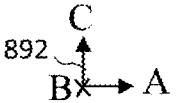
Figure 8A:
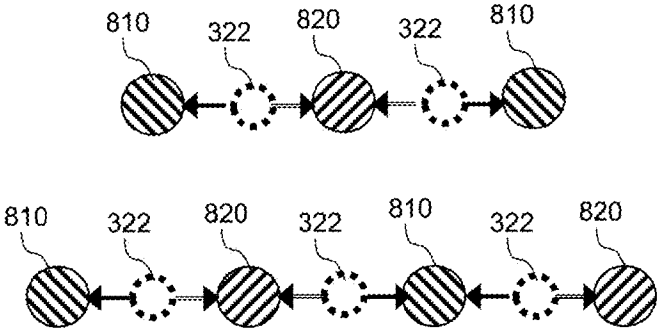
Figure 8C:
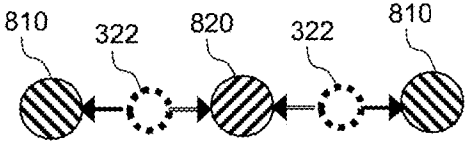

FIGS. 8A-8C are schematic diagrams showing examples of alignments between apertures 322 and detector elements such as electrodes 810 and 820. In these figures, electrodes 810 are biased to attract positively charged particles (represented as solid arrows) and electrodes 820 are biased to attract negatively charged particles (represented as double-solid arrows). The electrodes 810 and 820 lie in an A-C plane. Apertures 322 are depicted as dashed circles and lie in a different plane from the plane in which the electrodes 810 and 820 are located.

Referring to FIG. 8A, a rectangular array of electrodes 810 and 820 is shown. Apertures 322 also form a rectangular array but rotated by 45 degrees. Each dashed circle corresponding to an aperture 322 has two nearest neighbor electrodes either along the A-axis or the C-axis. Each nearest neighbor electrode collects charged particles with opposite sign from the other nearest neighbor electrode. Referring to FIG. 8B, electrodes 810 and 820 form a rectangular array. Apertures 322 also form a rectangular array but offset from that of the electrodes in the A- and C-directions. In this configuration, each dashed circle corresponding to an apertures 322 has four nearest neighbor electrodes of which two receive positively charged particles and the other two receive negatively charged particles.

FIG. 8C shows a hexagonal array of electrodes 810 and 820. The dashed circles corresponding to apertures 322 are arranged to between adjacent electrodes 810 and 820 so that positively and negatively charged particles are directed in opposite directions.

Figure 9:
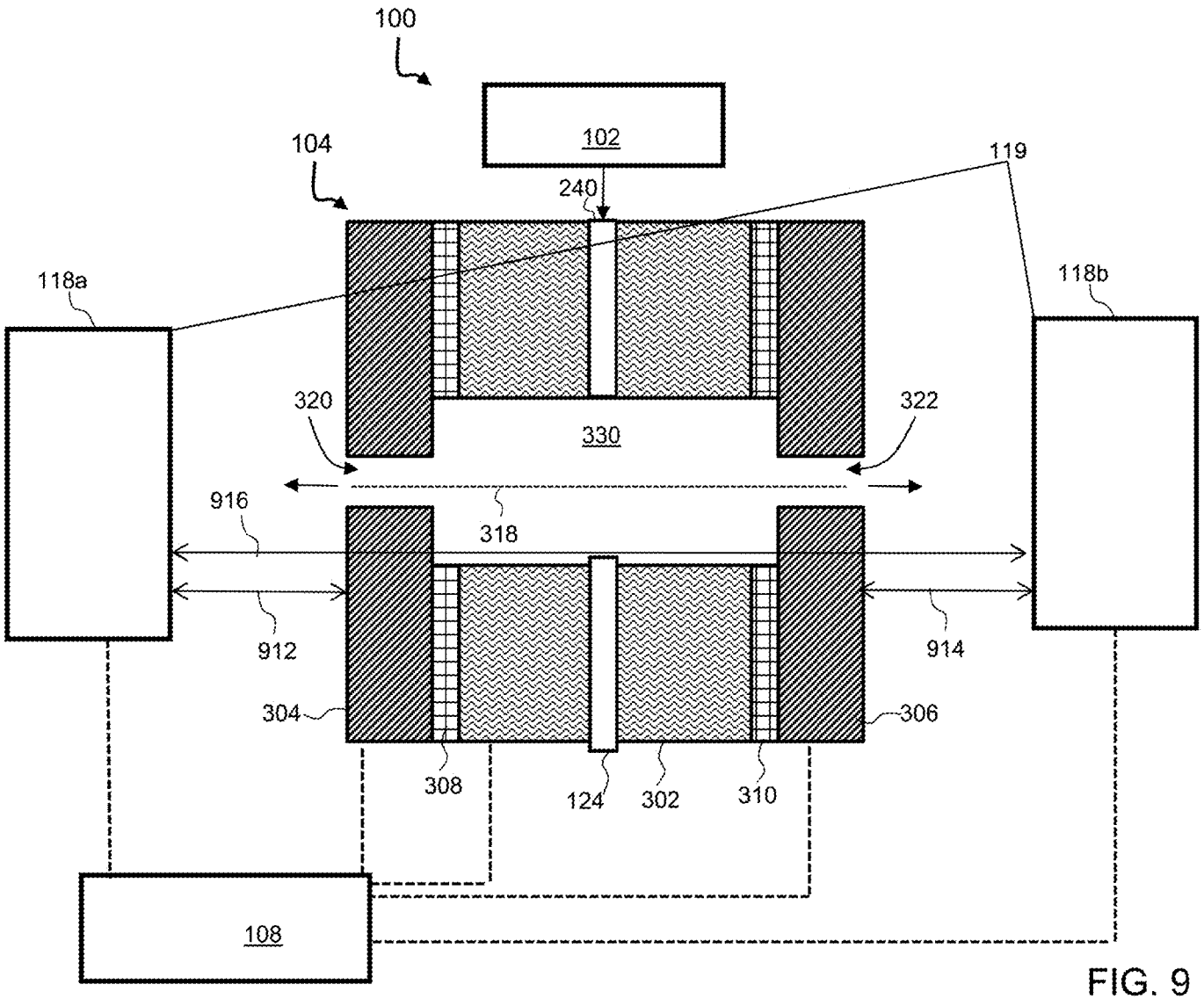
FIG. 9 is a schematic diagram of a mass spectrometer system.

FIG. 9 is a schematic diagram of an example of a mass spectrometer system 100 configured to detect positively and negatively charged particles at the same time. System 100 includes a detector subsystem 119 including two detectors 118*a* and 118*b*, one on each side of ion trap 104. In this example, ion source 102 injects ions into the ion trap 104 through an aperture 240 in a direction perpendicular to axis 318 of ion chamber 330. Gas particles to be analyzed enter the ion trap 104 through inlet 124 in a direction perpendicular to axis 318. In certain embodiments, the gas particles can enter through aperture 240 either before or after being ionized. As described earlier, the amplitude of the electrical potential applied to central electrode 302 of ion trap 104 is varied to selectively eject ions of particular mass-to-charge ratios from ion trap 104. When doing so, charged particles (e.g., positive and negative ions) are ejected through apertures 320 and 322. Detectors 118*a* and 118*b* are configured to collect the ejected charged particles.

In some embodiments, each of the detectors 118*a* and 118*b* can include a single Faraday cup or electrode configured to collect charged particles of one sign. For example, a Faraday cup in detector 118*a* can be biased to have an electric potential higher than that of electrode 304 to attract negatively charged particles. A Faraday cup in detector 118*b* can be biased to have an electric potential lower than that of electrode 306 to attract positively charged particles. In this approach, negatively charged particles are collected by detector 118*a* at the left-side of system 100, while positively charged particles are collect by detector 118*b* at the right-side of system 100, as shown in FIG. 9.

Alternatively, in some embodiments, each of the detectors 118*a* and 118*b* can include detector elements described in relation to FIGS. 4A-7C so that the detectors each collect positively and negatively charged particles, for example, at the same time. This can be advantageous when charged particles of both signs are ejected through apertures 320 and 322. By collecting charged particles of both signs at each side of system 100, the collection efficiency can be higher compared to the case where each side of system 100 collects only charged particles of one sign.

Distance 912 between detector 118*a* and electrode 304 of ion trap 104 can be 1 mm or less (e.g., 0.9 mm or less, 0.8 mm or less.) Distance 914 between electrode of detector 118*b* and electrode 306 of ion trap 104 can be 1 mm or less (e.g., 0.9 mm or less, 0.8 mm or less.) Distances 912 and 914 can be the same, or can be different, depending upon the configuration of detector subsystem 119 and the sample. In some embodiments, the distance 916 between electrodes of detectors 118*a* and 118*b* can be 10 mm or less (e.g., 8 mm or less, 6 mm or less, 4 mm or less, 2 mm or less, 1 mm or less).

Generally, a detector subsystem 119 can be directly secured to housing 122. In certain embodiments, housing 122 can be configured such that a detector of the detector subsystem 119 can be easily mounted or removed, for example by securing and holding by holding elements (e.g., screws or other fasteners). This allows certain detectors, which are damaged or contaminated to be easily replaced.

Detector subsystem 119 can include circuitry that measures electrical signals generated by electrodes collecting the charged particles. In certain embodiments, the generated electrical signals are sent to controller 108 for analysis.

In some embodiments, a biased repelling grid or magnetic field can be placed in front of a detector to prevent secondary charged particle emission, which may distort the measurement of ejected ions from ion trap 104. Alternatively, in certain embodiments, the secondary emission can be used for detection of the ejected ions.

Generally, geometric values described in relation to one embodiment can be applied to other embodiments described herein. For example, electrodes in a detector subsystem can have the same widths described in relation to electrodes 510 and 520 in FIG. 5A. As another example, the distance between aperture 322 and the electrodes of a detector subsystem can be the same as distance 546 described in relation to FIG. 5A.

Referring to FIG. 9 again, in some embodiments, one or both of the detectors 118*a* and 118*b* can be an ion source 102. That is, ion source 102—rather than being positioned as shown in FIG. 9—can be positioned along axis 318, as shown for example in FIGS. 1B and 2. Following the generation of ions by ion source 102 and the trapping of ions within ion trap 104, ion source 102 can then be operated as an ion detector (e.g., as ion detector 118*a* or 118*b* in FIG. 9) by applying a suitable voltage to one or more of the electrodes of ion source 102. As an example, referring to FIG. 2, by applying suitable voltages (as described above) to front electrode 210, to back electrode 220, or both, ions (e.g., positive or negative ions) can be detected by the electrode(s) and an ion current corresponding to the ions can be measured. In this manner, spatially separated detection of both positive and negative ions with different detectors can be achieved using a single dedicated detector and an ion source operating as a second detector, or dual ion sources operating as dual detectors.

Pressure Regulation Subsystem

Pressure regulation subsystem 120 is generally configured to regulate the gas pressure in gas path 128, which includes the interior volumes of ion source 102, ion trap 104, and detector subsystem 119. During operation of spectrometer 100, pressure regulation subsystem 120 maintains a gas pressure within spectrometer 100 that is 100 mTorr or more (e.g., 200 mTorr or more, 500 mTorr or more, 700 mTorr or more, 1 Torr or more, 2 Torr or more, 5 Torr or more, 10 Torr or more), and/or 100 Torr or less (e.g., 80 Torr or less, 60 Torr or less, 50 Torr or less, 40 Torr or less, 30 Torr or less, 20 Torr or less).

In some embodiments, pressure regulation subsystem 120 maintains gas pressures within the above ranges in certain components of spectrometer 100. For example, pressure regulation subsystem 120 can maintain gas pressures of between 100 mTorr and 100 Torr (e.g., between 100 mTorr and 10 Torr, between 200 mTorr and 10 Torr, between 500 mTorr and 10 Torr, between 500 mTorr and 50 Torr, between 500 mTorr and 100 Torr) in ion source 102 and/or ion trap 104 and/or detector 118. In certain embodiments, the gas pressures in at least two of ion source 102, ion trap 104, and detector subsystem 119 are the same. In some embodiments, the gas pressure in all three components are the same.

In certain embodiments, gas pressures in at least two of ion source 102, ion trap 104, and detector subsystem 119 differ by relatively small amounts. For example, pressure regulation subsystem 120 can maintain gas pressures in at least two of ion source 102, ion trap 104, and detector subsystem 119 that differ by 100 mTorr or less (e.g., 50 mTorr or less, 40 mTorr or less, 30 mTorr or less, 20 mTorr or less, 10 mTorr or less, 5 mTorr or less, 1 mTorr or less). In some embodiments, the gas pressures in all three of ion source 102, ion trap 104, and detector 118 differ by 100 mTorr or less (e.g., 50 mTorr or less, 40 mTorr or less, 30 mTorr or less, 20 mTorr or less, 10 mTorr or less, 5 mTorr or less, 1 mTorr or less).

Pressure regulation subsystem 120 can include a scroll pump, which has a pump container with one or more interleaving scroll flanges. Relative orbital motion between scroll flanges traps gases and liquids, leading to pumping activity to maintain gas pressures described in the preceding paragraphs. In certain embodiments, one scroll flange can be fixed while the other scroll flange orbits eccentrically with or without rotation. In some embodiments, both scroll flanges move with offset centers of rotation. The orbital motion of scroll flanges allows the scroll pump to generate only very small amplitude vibrations and low noise during operation. As such, the scroll pump can be directly coupled to ion trap 104 without introducing substantial detrimental effects during mass spectrum measurements. Because scroll pumps have few moving parts and generate only very small amplitude vibrations, the reliability of such pumps is generally very high.

In contrast to typical conventional mass spectrometers, a single mechanical pump such as a scroll pump can be used in the spectrometers disclosed herein to control gas pressures in each of the components of the system. By operating the mechanical pump at a relatively low rotational frequency, the mechanical coupling of vibrations into other components of the spectrometer can be substantially reduced or eliminated. Further, by operating at low rotational frequencies, the amount of power consumed by the pump is small enough that its modest requirements can be met by voltage source 106.

It has been determined experimentally that in some embodiments, by operating the single mechanical pump at a frequency of less than 6000 cycles per minute (e.g., less than 5000 cycles per minute, less than 4000 cycles per minute, less than 3000 cycles per minute, less than 2000 cycles per minute), the pump is capable of maintaining desired gas pressures within spectrometer 100, and at the same time, its power consumption requirements can be met by voltage source 106.

Housing

Figure 10:
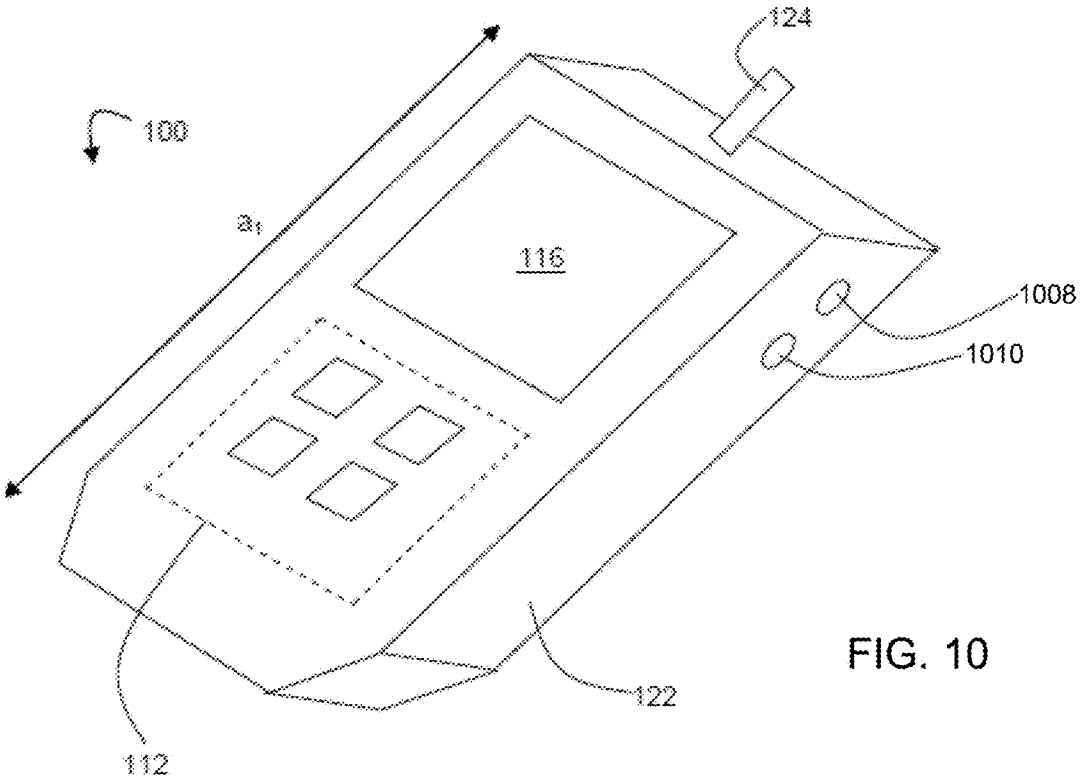
FIG. 10 is a schematic diagram of a housing of a mass spectrometer.

Mass spectrometer 100 includes a housing 122 that encloses the components of the spectrometer. FIG. 10 shows a schematic diagram of an embodiment of housing 122. Sample inlet 124 is integrated within housing 122 and configured to introduce gas particles into gas path 128. Also integrated into housing 122 are display 116 and user interface 112.

In some embodiments, display 116 is a passive or active liquid crystal or light emitting diode (LED) display. In certain embodiments, display 116 is a touchscreen display. Controller 108 is connected to display 116, and can display a variety of information to a user of mass spectrometer 100 using display 116. The information that is displayed can include, for example, information about an identity of one or more substances that are scanned by spectrometer 100. The information can also include a mass spectrum (e.g., measurements of abundances of ions detected by detector 118 as a function of mass-to-charge ratio). In addition, information that is displayed can include operating parameters and information for mass spectrometer 100 (e.g., measured ion currents, voltages applied to various components of mass spectrometer 100, names and/or identifiers associated with a current module installed in spectrometer 100, warnings associated with substances that are identified by spectrometer 100, and defined user preferences for operation of spectrometer 100). Information such as defined user preferences and operating settings can be stored in storage unit 114 and retrieved by controller 108 for display In some embodiments, user interface 112 includes a series of controls integrated into housing 122. The controls, which can be activated by a user of spectrometer 100, can include buttons, sliders, rockers, switches, and other similar controls. By activating the controls of user interface 112, a user of spectrometer 100 can initiate a variety of functions. For example, in some embodiments, activation of one of the controls initiates a scan by spectrometer 100, during which spectrometer draws in a sample (e.g., gas particles) through sample inlet 124, generates ions from the gas particles, and then traps and analyzes the ions using ion trap 104 and detector subsystem 119. In certain embodiments, activation of one of the controls resets spectrometer 100 prior to performing a new scan. In some embodiments, spectrometer 100 includes a control that, when activated by a user, re-starts spectrometer 100 (e.g., after changing one of the components of spectrometer 100 such as a module and/or a filter connected to sample inlet 124).

When display 116 is a touchscreen display, a portion, or even all, of user interface 112 can be implemented as a series of touchscreen controls on display 116. That is, some or all of the controls of user interface 112 can be represented as touch-sensitive areas of display 116 that a user can activate by contacting display 116 with a finger.

In some embodiments, mass spectrometer 100 can include a limit sensor 1008 coupled to controller 108. Limit sensor 1008 detects gas particles in the environment surrounding mass spectrometer, and reports gas concentrations to controller 108. In certain embodiments, mass spectrometer 100 can include an explosion hazard sensor 1010. Explosion hazard sensor 1010, which is connected to controller 108, detects the presence of explosive substances in the vicinity of spectrometer 100.

Housing 122 is generally shaped so that it can be comfortably operated by a user using either one hand or two hands. In general, housing 122 can have a wide variety of different shapes. However, due to the selection and integration of components of spectrometer 100 disclosed herein, housing 122 is generally compact. As shown in FIG. 10, regardless of overall shape, housing 122 has a maximum dimension $a_1$ that corresponds to a longest straight-line distance between any two points on the exterior surface of the housing. In some embodiments, $a_1$ is 35 cm or less (e.g., 30 cm or less, 25 cm or less, 20 cm or less, 15 cm or less, 10 cm or less, 8 cm or less, 6 cm or less, 4 cm or less).

Further, due to the selection of components within spectrometer 100, the overall weight of spectrometer 100 is significantly reduced relative to conventional mass spectrometers. In certain embodiments, for example, the total weight of spectrometer 100 is 4.5 kg or less (e.g., 4.0 kg or less, 3.0 kg or less, 2.0 kg or less, 1.5 kg or less, 1.0 kg or less, 0.5 kg or less).

Operating Modes

Figure 11:
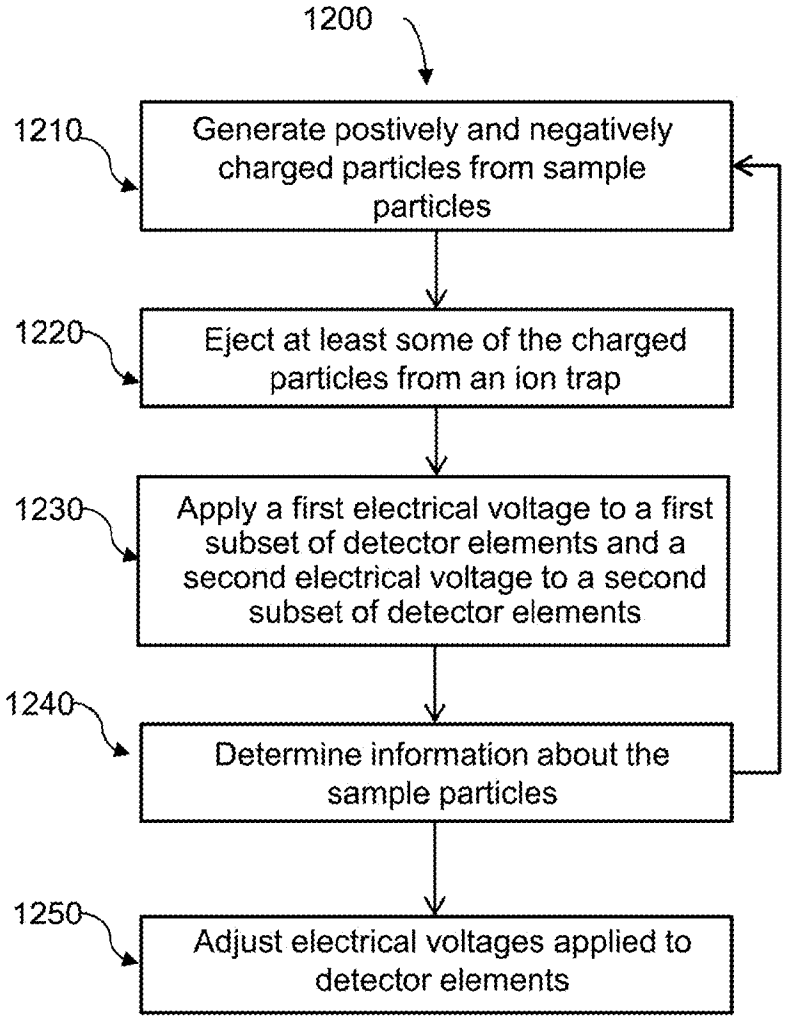
FIG. 11 is a flow chart showing a sequence of steps performed in different operating modes to scan and analyze sample particles.

In general, mass spectrometer 100 operates according to a variety of different operating modes. FIG. 11 is a flow chart 1200 that shows a sequence of steps that are performed in the different operating modes to scan and analyze sample particles. In step 1210, positively and negatively charged particles are generated from sample particles. Controller 108 applies an electronic signal to an ion source. The ions generated by ion source 102 can be positive or negative ions (or both) depending on the ionization mode of the ion source 102. Generally, controller 108 can adjust electrical voltages applied to detector elements based on changes in ionization modes of the ion source.

In some embodiments, electrons and/or ions generated by ion source 102 can collide with neutral sample particles to generate ion particles to be analyzed. The ionization of sample particles can occur in the ion source 102 or in the ion trap 104. Sample particles can generate positively charged particles, negatively charged particles, or both from colliding with positive ions. Sample particles can generate either positively charged particles, negatively charged particles, or both from colliding with negative ions. Both positively and negatively charged particles are trapped within ion trap 104 as described in preceding sections.

In step 1220, controller 108 applies an electrical signal to ion trap 104 to eject a plurality of particles, where the particles include at least some of the positively and/or negatively charged particles. In some embodiments, the particles are ejected through a common aperture of an electrode of the ion trap 104. In certain embodiments, the electrode of the ion trap 104 has an array of electrodes through which the particles are ejected, as described above. The ion trap 104 can have electrodes on two sides, and particles can be ejected through apertures on both sides of ion trap 104.

In step 1230, the controller 108 applies electrical voltages to detector elements of detector subsystem 119. Further, controller 108 can apply a reference electrical voltage to the electrodes of ion trap 104. By selectively applying electrical voltages to the detector elements that are either larger or smaller than the reference electrical voltage, controller 108 controls which detector elements receive positively charged particles and which detector elements receive negatively charged particles. For example, controller 108 can apply a first electrical voltage to a first subset of the plurality of detector elements so that the first subset of the plurality of detector elements receives at least some of the positively charged particles from ion trap 104 and generates a first electrical signal. The controller 108 can also apply a second electrical voltage to a second subset of the plurality of detector elements so that the second subset of elements receives at least some of the negatively charged particles and from ion trap 104 and generates a second electrical signal.

The first and second electrical signals can be used by controller 108 to determine information about the sample particles in step 1240. In certain embodiments, the information can include peak magnitudes and/or number of peaks of the first and second electrical signals. For example, the first and second electrical signals can be measured as a function of the amplitude of the RF voltage that is applied to central electrode 302 of the ion trap. Thus, the electrical signals can indicate the abundance of charged particles according to the mass-to-charge ratio as described in preceding sections and provide mass spectra of detected charged particles.

Additional system features and methods of operation, including methods for varying ionization modes for certain samples of interest, methods for modifying various system parameters during data acquisition, and methods for determining information about samples, are disclosed for example in U.S. patent application Ser. No. 14/268,544, filed on May 2, 2014, now U.S. Pat. No. 8,816,272, the entire contents of which are incorporated herein by reference.

Some sample particles fragment similarly when positively or negatively ionized. Examples include molecules containing conjugated aromatic ring systems, such as benzene, naphthalene, and anthracene. The systems and methods disclosed herein can increase the efficiency with which such samples are detected, because detection of mass spectral information corresponding to either positive or negative ions of the sample particles can be used for identification.

Some sample particles generate positive and negative ions with rather distinct associated mass spectral information. As an example, nitro-aromatic explosive compounds typically generate positive and negative ions with different—and differentiable—mass spectra. Thus, the mass spectral information corresponding to positive and negative ions of the sample particles can act as different "fingerprints" of the sample particles, and the two mass spectra can complement each other in identifying the sample particles, increasing the selectivity with which measurements are performed.

In step 1250, controller 108 can adjust electrical voltages applied to detector elements of the detector subsystem 119. The adjustment can be based on the information determined in step 1240. In some embodiments, for example, controller 108 receives and analyzes the first and second electrical signals to generate a feedback signal. The feedback signal is transmitted to voltage source 106 which sends adjusted electrical voltages to the detector elements based on the feedback signal.

Figure 12:
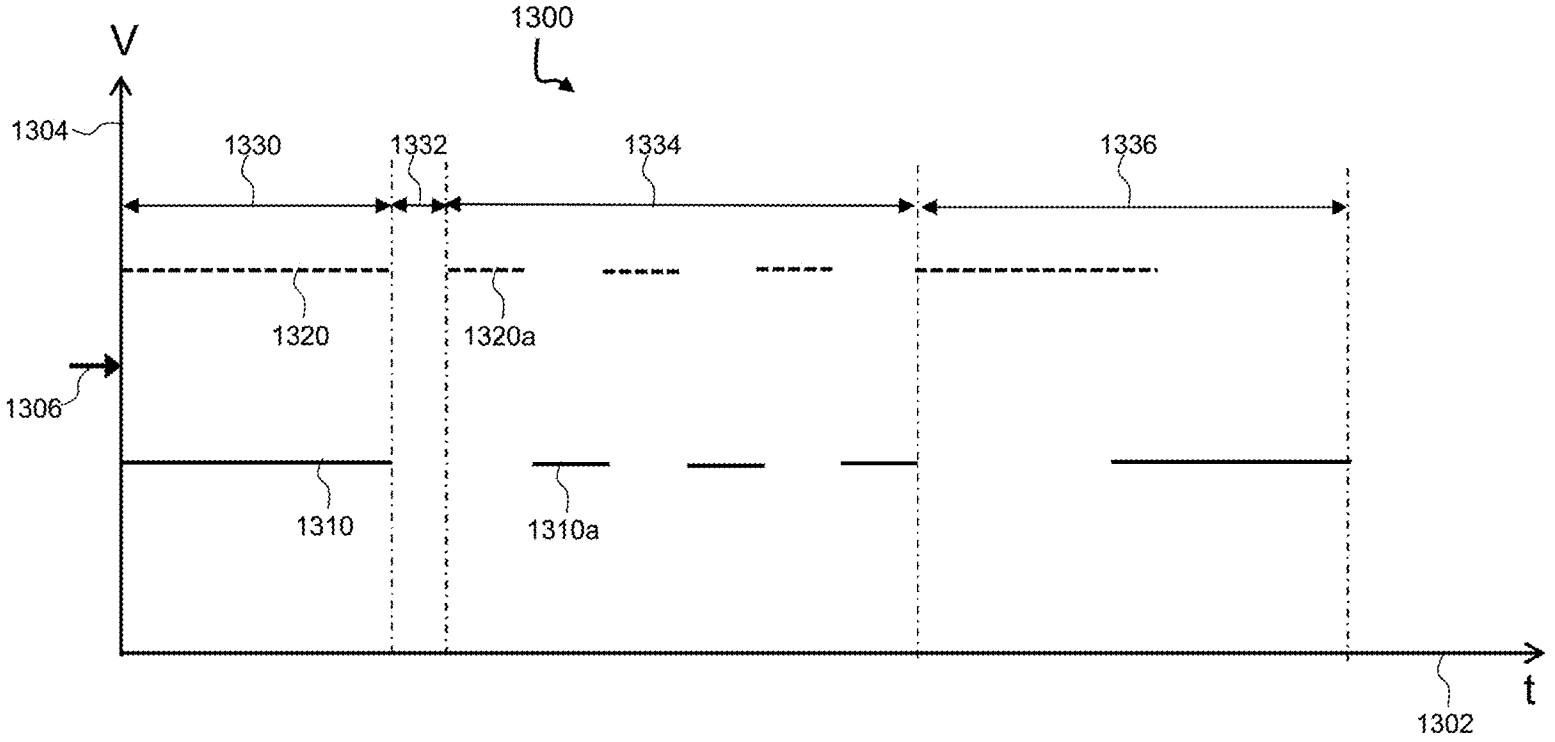
FIG. 12 is a schematic plot showing an example operation of electrical voltages applied to first and second subsets of detector elements.

FIG. 12 is a schematic plot 1300 showing example electrical voltages applied to first and second subsets of detector elements. Plot 1300 is only one example provided for illustrative purposes. More generally, the systems disclosed herein can be configured to apply a wide variety of different voltages to detector elements, as has been described above.

In FIG. 12, the horizontal axis 1302 corresponds to time and is related to the amplitude of the RF voltage applied to central electrode of ion trap 104. For example, the time can be linearly related to the amplitude. The amplitude can be periodically modulated. Vertical axis 1304 corresponds to the voltage applied to respective subsets of the detector elements. In this example, arrow 1306 indicates the reference electrical voltage applied to electrode (e.g., electrode 306) of ion trap 104) which has an aperture through which charged particles exit ion trap 104. Solid line 1310 corresponds to the first electrical voltage applied to the first subset of detector elements, and dashed line 1320 corresponds to the second electrical voltage applied to the second subset of detector elements. The first electrical voltage is smaller than the reference electrical voltage, and thus the first subset of elements receives positively charged particles. The second electrical voltage is higher than the reference electrical voltage, and thus the second subset of elements receives negatively charged particles.

For a first interval of time 1330, the first electrical voltage and the second electrical voltage are applied at the same time. Thus, the first subset of elements can receive positively charged particles and the second subset of elements can receive negatively charged particles during this common time. Then, for a second time interval 1332, no electrical voltages are applied to the first and second subsets of detector elements. The second interval 1332 can correspond, for example, to a time period during which there is no need to collect charged particles, e.g., when the controller 108 is implementing other processes such as analyzing acquired data and/or changing the operating configuration of the system. Because no voltages are applied to the first and second subsets of elements, the power consumption of the system during interval 1332 is typically reduced.

Next, during interval 1334, the first and second electrical voltages are applied sequentially and repeatedly to the first and second subsets of detector elements, respectively. In some embodiments, this process can be used when controller 108 sequentially detects and analyzes the charged particles of only one sign (e.g., whichever type of charged particles are more abundant). In certain embodiments, the types of sample particles change over time. Accordingly, the first and second electrical voltages can be alternately applied in sequence over time until a preferred ionization mode (or modes) is determined by controller 108 for the sample. Methods for varying ionization modes and determining preferred ionization modes are disclosed, for example, in U.S. Pat. No. 8,816,272. In the example shown in FIG. 12, the durations over which the first and second potentials are applied are the same, and the potentials are applied one at a time. More generally, however, the potentials can be applied for unequal time intervals, and can be applied during time intervals that overlap. Further, the intervals during which the first and second potentials are applied to detector elements can change during sample analysis. Controller 108 controls the various durations and relative timings of the intervals associated with the first and second electrical voltages.

Next, during interval 1336, only the second electrical voltage is applied to the second subset of detector elements during a first portion of the interval, and then only the first electrical voltage is applied to the first subset of detector elements during a second portion of the interval. The first and second portions of interval 1336 overlap so that during this period of overlap, both the first and second electrical voltages are applied. Accordingly, at various times during interval 1336, the detector elements receive only positively charged particles, only negatively charged particles, or both positively and negative charged particles.

Plot 1300 is an example showing that controller 108 can apply electrical voltages to detector elements in a flexible manner over time. The adjustment of the applied electrical voltages can be based on a variety of different types of information determined by controller 108, including information about the abundances of different charged particles.

Figure 13:
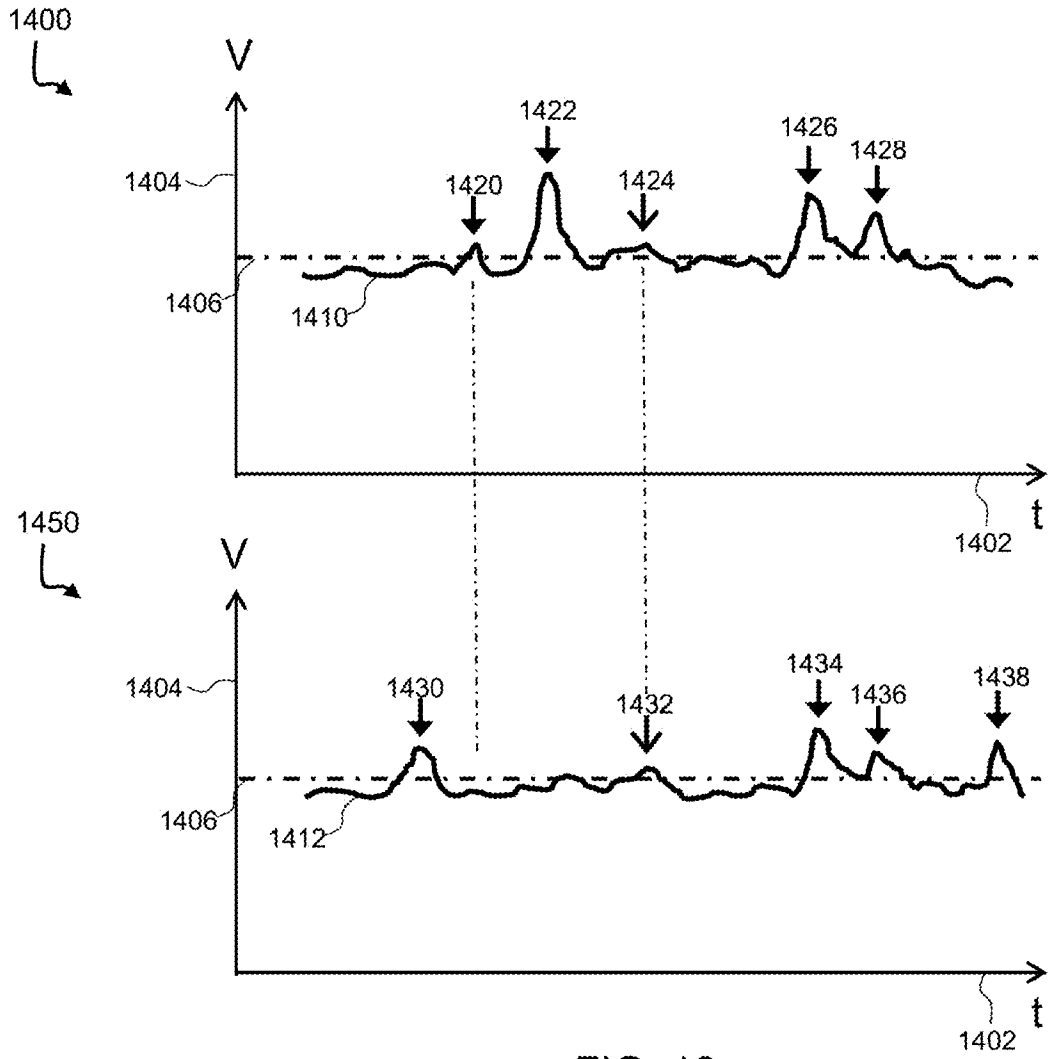
FIG. 13 is a series of schematic plots showing first and second electrical signals measured over time.

FIG. 13 is a series of schematic plots 1400 and 1450 showing first electrical signal 1410 and second electrical signal 1412 measured by detector subsystem 119. Horizontal axis 1402 corresponds to measurement time and vertical axis 1404 corresponds to signal amplitude in volts. The time is related to the amplitude of the RF voltage applied to central electrode 302 and the mass-to-charge ratio of the generated ions. Voltage threshold 1406 determines whether the measured signal is above noise level. For example, only signals above the voltage threshold 1406 are considered to correspond to reliable detection of charged particles.

Generally, peaks in the first and second measured electrical signals 1410 and 1423 are related to the abundance of charged particles that are received at specific times. However, noise can give arise to false peaks. In this example, controller 108 identifies peaks 1420-1428 and peaks 1430-1438 above voltage threshold 1406. Peaks 1420, 1424 and 1432 are close to the voltage threshold 1406. Determining whether such peaks genuinely correspond to charged particles from the sample, or are due instead to measurement noise, can improve the accuracy of the measurements.

In some embodiments, peaks in one measured signal (e.g., plot 1400) that are sufficiently close in amplitude to voltage threshold 1406 (e.g., within 10% or less, 5% or less, 3% or less of voltage threshold 1406) such as peaks 1420 and 1424 can be compared to portions of the other measured signal (e.g., plot 1450) at corresponding times to determine whether the peaks represent true positive detection of charged particles. For example, referring to FIG. 13, because peak 1420 in plot 1400 does not have a counterpart peak in plot 1450 at the same time, peak 1420 may be identified as a real detection of charged particles. On the other hand, peak 1424 has a counterpart peak 1432 in plot 1450 at the same time, suggesting that these two peaks may arise from common noise during measurement, and can be discarded. In certain embodiments, controller 108 can be configured to compare electrical signals 1410 and 1412 to determine which peaks correspond to genuine detection of charged particles, and which peaks correspond to measurement noise and can be eliminated. The comparison can include, for example, calculating a correlation between the electrical signals.

Generally, controller 108 can be used to adjust electrical voltages applied to individual detector elements so as to reconfigure subsets of the plurality of detector elements. Referring to FIG. 7C again, detector subsystem 119 includes a first subset of detector elements 750 that receives positively charged particles and a second subset of detector elements 752 that receives negatively charged particles. Controller 108 can adjust electrical voltages applied to any detector element in these subsets. For example, among the nine members of electrodes within subset 750, three electrodes can have their electrical voltages increased to be higher than reference electrical voltage of ion trap 104 so that the three electrodes become a member of the second subset 752. As another example, certain members of the second subset 752 can be changed to members of the first subset by decreasing their applied electrical voltages to be lower than the reference electrical voltage. Accordingly, the number of detector elements within a given subset can be changed flexibly.

Controller 108 is also configured to adjust the electrical voltages applied to the detector elements based on information determined from the electrical signals measured by the elements. For example, if the measured electrical signals indicate that positively charged particles are more abundant, controller 108 can adjust electrical voltages applied to detector elements so that a larger number of detector elements collect positively charged particles. On the other hand, if the electrical signals indicate that negatively charged particles to be more abundant, controller 108 can adjust electrical voltages applied to detector elements so that a larger number of detector elements collect negatively charged particles.

In some embodiments, the charged particles that are relatively less abundant may provide more useful information, e.g., information that can be used to identify the composition of sample particles. Accordingly, the controller 108 can adjust the electrical voltages so that a larger number of detector elements collect the charged particles that are determined to be less abundant, which can increase the sensitivity with which the less abundant charged particles are detected.

In certain embodiments, controller 108 can generate a feedback signal based on information that includes peak magnitudes and/or a number of peaks in the measured electrical signals. For example, referring to FIG. 13, suppose for purposes of illustration that signal 1410 corresponds to the detection of positively charged ions, while signal 1412 corresponds to the detection of negatively charged ions.

The amplitude of signal 1410 at the temporal position of peak 1422 is significantly higher than the amplitude of signal 1412 at the same time, suggesting that at that time, the abundance of positively charged ions is significantly higher than the abundance of negatively charged ions. Controller 108, measuring this difference in signal amplitude, can send a feedback signal to voltage source 106 to change the electrical voltages applied to the detector elements so that more elements are configured to detect positively charged particles, since such particles are relatively more abundant. Conversely, at other times (e.g., at the temporal position of peak 1438), when negatively charged particles are relatively more abundant based on the difference in amplitudes between signals 1410 and 1420, controller 108 can send a feedback signal to voltage source 106 to change the electrical voltages applied to the detector elements so that more elements are configured to detect negatively charged particles. Changing the voltages applied to the detector elements effectively changes the grouping of such elements into different subsets. This dynamic reconfiguration of the detector subsystem by controller 108 can be advantageous in that, for example, the detection mode of detection subsystem 119 can be matched to the ionization mode of ion source 102.

Plots 1400 and 1450 show the same number of peaks in first and second electrical signals 1410 and 1412. However, more generally, the number of peaks in these two signals can be the same or different. A larger number of peaks in one signal can indicate that the corresponding charged particles are more abundant and/or can provide richer information for identifying the composition of the charged particles. Accordingly, controller 108 can be configured to increase the number of detector elements that collect charged particles corresponding to the electric signal with a larger number of peaks.

In some embodiments, the magnitude of the electrical voltages applied to the detector elements can be adjusted to account for varying kinetic energies of the charged particles. For example, when positively charged particles and/or negatively charged particles of low kinetic energy are being collected, electrical voltages of smaller magnitude can be applied to detector elements because charged particles of lower kinetic energy are deflected to a greater extent than charged particles of greater kinetic energy by the same electrical potential over the same distance between the ion trap and the detector subsystem. Reducing the magnitude of the applied voltages reduces power consumption by the system, which is an important consideration for compact, handheld mass spectrometry systems. Controller 108 can use information about the kinetic energies of detected particles to dynamically adjust the magnitudes of the applied potentials.

In some embodiments, one or more additional ion optical elements can also be used to direct positive and negative ions to corresponding detectors for analysis. For example, referring to FIG. 5C, in some embodiments, the systems disclosed herein include optional lens 581. By applying a suitable voltage to lens 581, ballistic ions—produced during ionization of sample particles—can be blocked from reaching detectors 510 and 520. Further, lens 581 can direct ions for analysis to detectors 510 and 520 by applying a different voltage to the lens.

In general, the systems disclosed herein can include one or more lenses 581. The lenses can be formed from a variety of conductive materials, including aluminum, copper, and stainless steel, and the apertures formed in such lenses (e.g., through which the ions pass) can have a variety of different cross-sectional shapes, including circular, elliptical, square, rectangular, and other regular or irregular geometric shapes.

Hardware, Software, and Electronic Processing

Any of the method steps, features, and/or attributes disclosed herein can be executed by controller 108 (e.g., electronic processor 110 of controller 108) and/or one or more additional electronic processors (such as computers or preprogrammed integrated circuits) executing programs based on standard programming techniques. Such programs are designed to execute on programmable computing apparatus or specifically designed integrated circuits, each optionally including a processor, a data storage system (including memory and/or storage elements), at least one input device, and at least one output device, such as a display. The program code is applied to input data to perform functions and generate output information which is applied to one or more output devices. Each such computer program can be implemented in a high-level procedural or object-oriented programming language, or an assembly or machine language. Furthermore, the language can be a compiled or interpreted language. Each such computer program can be stored on a computer readable storage medium (e.g., optical storage medium, magnetic storage medium, persistent solid state storage medium) that, when read, can cause the processor to perform the analysis and control functions described herein.

Examples

Figure 14:
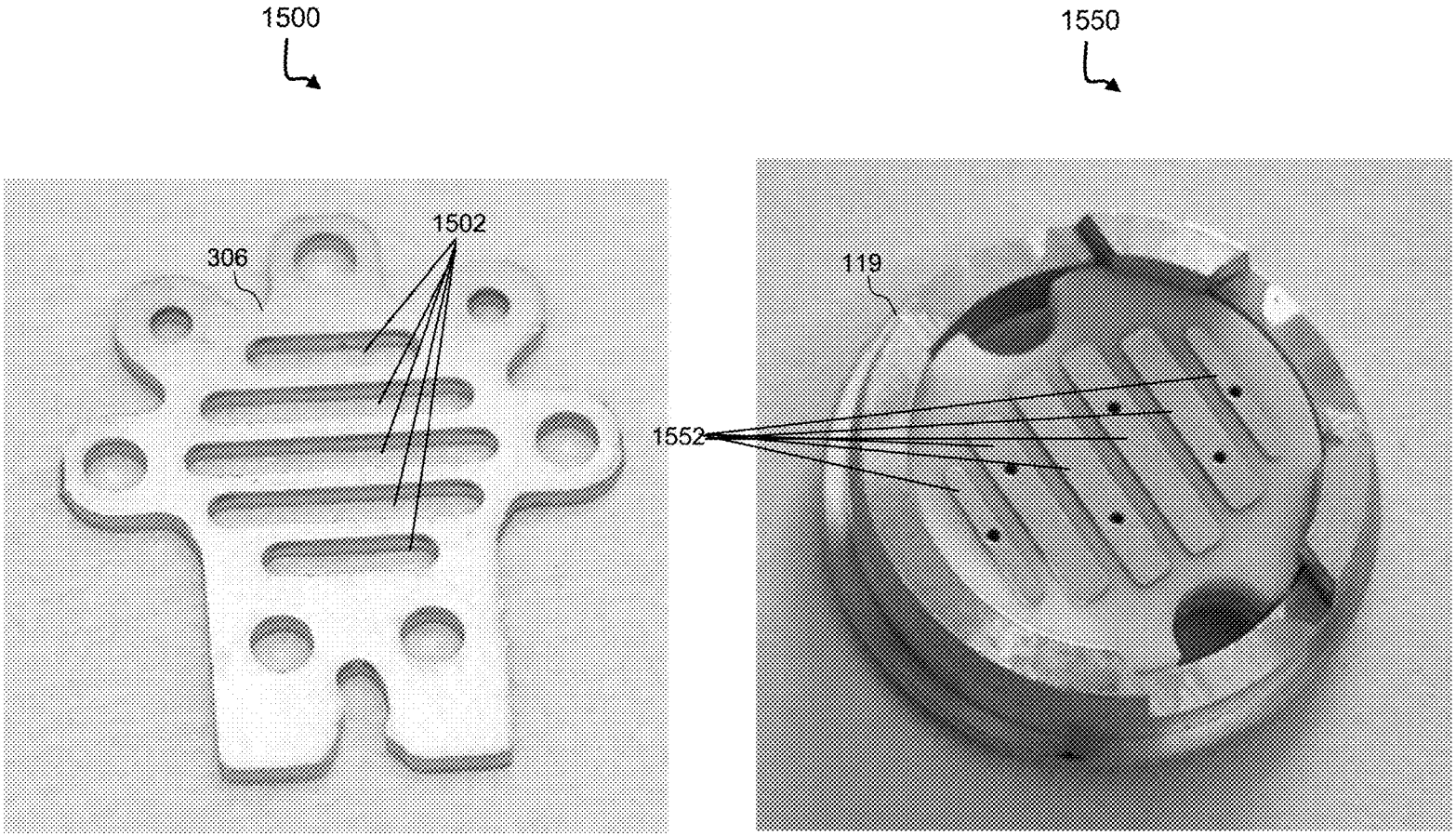
FIG. 14 is a series of images showing examples of electrodes.

FIG. 14 is a series of images 1500 and 1550 showing examples of electrodes. Image 1500 shows an electrode 306 of an ion trap with five slit-shaped apertures 1502 of varying lengths. Other electrodes 304 and 302 of the ion trap can have similar slit-shaped apertures. The ion trap is formed by stacking the electrodes 302, 304 and 306. Image 1550 shows a detector subsystem 119 having six electrodes 1552 of varying lengths. When assembled, the detector subsystem 119 is aligned with electrode 306 in the manner disclosed above in connection with FIG. 6B.

FIG. 15 is a table 1600 showing simulation results of ion collection efficiencies for various examples of detector subsystems. For the simulation, a ~4 eV Boltzmann ion energy distribution at a pressure of 1 Torr was used. The bias voltages of electrodes was assumed to be +50 to −50 V along with an aperture to electrode distance of 0.94-1 mm. The ion collection efficiency corresponds to the fraction of ions in the initial ion energy distribution that were detected by detector subsystem 119. As shown in the table, a detector subsystem 119 that included a series of concentric ring electrodes alternately biased to detect positive and negative ions provided the highest ion collection efficiency among the four configurations simulated.

The methods and systems disclosed herein can be used for mobile scanning of substances by personnel without special training. For example, applications include on-the-spot security scanning in transportation hubs such as airports and train stations. Such applications benefit from mass spectrometers that are compact, require relatively low power to operate, and provide information that can readily be interpreted by personnel without advanced training. The systems disclosed herein can also be used in laboratories to provide rapid characterization of unknown chemical compounds. Due to their low cost and tiny footprint, laboratories can provide workers with personal spectrometers, reducing or eliminating the need to schedule analysis time at a centralized mass spectrometry facility. Additional applications include medical diagnostics testing, both in clinical settings and in residences of individual patients. Technicians performing such testing can readily interpret the information provided by such spectrometers to provide real-time feedback to patients, and also to provide rapidly updated information to medical facilities, physicians, and other health care providers.

Generally, the disclosed systems can operate in a variety of detection modes to collect positively charged particles, negatively charged particles, or both, depending on the nature of the samples. The flexibility of operating in various detection modes can reduce data acquisition time while increasing sensitivity and/or selectivity by determining information about the samples being analyzed and adjusting the detection modes. The spectrometers can be used to provide a variety of information to users including identification of chemical substances scanned by the spectrometers and/or associated contextual information, including information about a class to which substances belong (e.g., acids, bases, strong oxidizers, explosives, nitrated compounds), information about hazards associated with the substances, and safety instructions and/or information.

The spectrometers operate at internal gas pressures that are higher than conventional mass spectrometers. By operating at high pressures, the size and power consumption of the spectrometers is significantly reduced relative to conventional mass spectrometers. Moreover, even though the spectrometers operate at higher pressures, the resolution of the spectrometers is sufficient to permit accurate identification and quantification of a wide variety of chemical substances.

OTHER EMBODIMENTS

While this disclosure contains many specific implementation details, these should not be construed as limitations on the scope of the disclosure, but rather as descriptions of features specific to particular embodiments. Features that are described in this disclosure in the context of separate embodiments can also generally be implemented in combination in other embodiments. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can generally be excised from the combination, and the claimed combination may be directed to a subcombination or variation of a subcombination.

In addition to the embodiments disclosed herein, other embodiments are within the scope of the disclosure.

What is claimed is:

1. A mass spectrometry system, comprising:

an ion trap comprising first and second electrodes positioned on opposite sides of the ion trap along an axis of the ion trap;

an ion source configured to introduce charged particles into the ion trap;

a detector subsystem comprising at least one first detector comprising a first plurality of detector elements positioned to receive charged particles emerging from the ion trap through a first aperture in the first electrode, and at least one second detector comprising a second plurality of detector elements positioned to receive charged particles emerging from the ion trap through a second aperture in the second electrode; and a controller electrically connected to the ion source, the ion trap, and the detector subsystem and configured so that during operation of the system, the controller:

applies an electrical signal to the ion source to generate positively and negatively charged particles from sample particles in the system;

applies an electrical signal to the ion trap to eject a plurality of particles from the ion trap through the first and second apertures, wherein the plurality of particles comprises at least some of the positively charged particles and at least some of the negatively charged particles;

applies a first electrical voltage to a first subset of the first plurality of detector elements so that the first subset of the first plurality of detector elements receives positively charged particles ejected through the first aperture and generates a first electrical signal;

applies a second electrical voltage to a second subset of the second plurality of detector elements so that the second plurality of detector elements receives negatively charged particles ejected through the second aperture and generates a second electrical signal;

compares the first and second electrical signals at a common detection time, and determines that a peak in the first electrical signal sufficiently close in amplitude to a voltage threshold signal corresponds to detected charged particles if the second electrical signal does not comprise a corresponding peak at the common detection time;

at least one of:

adjusts the first plurality of detector elements based on the first electrical signal by applying the first electrical voltage to a subset of the first plurality of detector elements that is different from the first subset to cause the subset of the first plurality of detector elements to receive positively charged particles; and adjusts the second plurality of detector elements based on the second electrical signal by applying the second electrical voltage to a subset of the second plurality of detector elements that is different from the second subset to cause the subset of the second plurality of detector elements to receive negatively charged particles; and determines information about the sample particles based on electrical signals generated by at least one of the adjusted first and second pluralities of detector elements.

2. The system of claim 1, wherein the first plurality of detector elements comprises an array of detector elements and the at least one second detector element comprises an array of second detector elements.

3. The system of claim 1, wherein the first plurality of detector elements comprises a plurality of concentric ring-shaped electrodes, and the at least one second detector element comprises a plurality of concentric ring-shaped electrodes.

4. The system of claim 1, wherein the controller is configured so that during operation of the system, the controller determines, for each peak in the first electrical signal and the second electrical signal that is sufficiently close in amplitude to the voltage threshold signal, whether the peak corresponds to detected charged particles by comparing amplitudes of the first and second electrical signals at a common detection time corresponding to the peak.

5. The system of claim 4, wherein the controller is configured so that during operation of the system, for each peak that is determined to correspond to detected charged particles:

if the peak corresponds to positively charged particles, the controller adjusts the first plurality of detector elements by increasing a number of elements in the first plurality of detector elements to which the first electrical voltage is applied; and if the peak corresponds to negatively charged particles, the controller adjusts the second plurality of detector elements by increasing a number of elements in the second plurality of detector elements to which the second electrical voltage is applied.

6. The system of claim 1, wherein the controller is configured so that during operation of the system, when a peak is detected in the first electrical signal and a corresponding peak is not detected in the second electrical signal, the controller adjusts the first plurality of detector elements to increase a number of elements in the first plurality of detector elements to which the first electrical voltage is applied.

7. The system of claim 1, wherein the controller is configured so that during operation of the system, the controller:

compares amplitudes of each of the first and second electrical signals to threshold values to detect peaks in the first and second electrical signals;

determines a number of peaks in each of the first and second electrical signals;

if the number of peaks in the first electrical signal is greater than the number of peaks in the second electrical signal, increases a number of elements in the first plurality of detector elements to which the first electrical voltage is applied; and if the number of peaks in the second electrical signal is greater than the number of peaks in the first electrical signal, increases a number of elements in second plurality of detector elements to which the second electrical voltage is applied.

8. The system of claim 1, wherein the controller is configured so that during operation of the system, the controller adjusts at least one of a number of elements in the first plurality of detector elements to which the first electrical voltage is applied, and a number of elements in the second plurality of detector elements to which the second electrical voltage is applied, based on an ionization mode of the ion source.

9. The system of claim 1, wherein the ion source is at least partially separated from the ion trap and comprises the plurality of second detector elements.

10. The system of claim 9, wherein at least some of the plurality of second detector elements are electrodes of the ion source.

11. The system of claim 1, wherein the ion source is at least partially separated from the ion trap and comprises the plurality of first detector elements.

12. The system of claim 11, wherein at least some of the plurality of first detector elements are electrodes of the ion source.

* * * * *